US008625824B2

(12) United States Patent
Chen et al.

(10) Patent No.: US 8,625,824 B2
(45) Date of Patent: Jan. 7, 2014

(54) FLAT SPEAKER UNIT AND SPEAKER DEVICE THEREWITH

(75) Inventors: Kuan-Wei Chen, Taichung County (TW); Ming-Daw Chen, Hsinchu (TW); Chang-Ho Liou, Changhua County (TW); Kuo-Hua Tseng, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 223 days.

(21) Appl. No.: 12/979,341

(22) Filed: Dec. 28, 2010

(65) Prior Publication Data

US 2011/0255721 A1 Oct. 20, 2011

Related U.S. Application Data

(63) Continuation-in-part of application No. 12/187,381, filed on Aug. 7, 2008, now Pat. No. 8,107,651, and a continuation-in-part of application No. 12/175,467, filed on Jul. 18, 2008, now Pat. No. 8,155,356, and a continuation-in-part of application No. 12/370,598, filed on Feb. 13, 2009, now Pat. No. 8,139,794, and a continuation-in-part of application No. 12/370,599, filed on Feb. 13, 2009, now Pat. No. 8,196,282, and a continuation-in-part of application No. 12/541,145, filed on Aug. 13, 2009, now Pat. No. 8,391,520, and a continuation-in-part of application No. 12/759,710, filed on Apr. 14, 2010, now Pat. No. 8,385,586.

(60) Provisional application No. 61/107,328, filed on Oct. 21, 2008, provisional application No. 61/108,027, filed on Oct. 24, 2008, provisional application No. 61/300,418, filed on Feb. 1, 2010.

(30) Foreign Application Priority Data

| | | |
|---|---|---|
| Sep. 4, 2007 | (TW) | 96132878 A |
| Sep. 6, 2007 | (TW) | 96133208 A |
| Aug. 1, 2008 | (TW) | 97129296 A |
| Mar. 10, 2009 | (TW) | 98107677 A |
| May 25, 2009 | (TW) | 98117344 A |
| Aug. 10, 2009 | (TW) | 98126821 A |

(51) Int. Cl.
*H04R 25/00* (2006.01)

(52) U.S. Cl.
USPC ..... 381/191

(58) Field of Classification Search
USPC ..... 381/191
See application file for complete search history.

(56) References Cited

U.S. PATENT DOCUMENTS

| | | | | |
|---|---|---|---|---|
| 2,855,467 | A | 10/1958 | Curry | |
| 3,894,199 | A | 7/1975 | Tamura et al. | |
| 4,205,206 | A * | 5/1980 | Eishima et al. | 381/180 |
| 6,483,924 | B1 * | 11/2002 | Kirjavainen | 381/191 |
| 2001/0026625 | A1 * | 10/2001 | Azima et al. | 381/152 |
| 2005/0093401 | A1 * | 5/2005 | Raisanen | 310/328 |
| 2006/0072770 | A1 * | 4/2006 | Miyazaki | 381/116 |
| 2007/0029899 | A1 * | 2/2007 | Matsuzawa | 310/334 |
| 2007/0195976 | A1 | 8/2007 | Sekino et al. | |
| 2009/0016552 | A1 | 1/2009 | Medley et al. | |
| 2009/0060233 | A1 | 3/2009 | Liou et al. | |
| 2009/0245547 | A1 | 10/2009 | Lee et al. | |
| 2010/0104116 | A1 | 4/2010 | Liou et al. | |

FOREIGN PATENT DOCUMENTS

| | | |
|---|---|---|
| JP | 60-046196 | 3/1985 |
| JP | 2006-025109 | 1/2006 |
| JP | 2009-117888 | 5/2009 |
| KR | 100751012 | 8/2007 |
| TW | 200726300 | 7/2007 |
| TW | 200913753 | 3/2009 |
| TW | 200939860 | 9/2009 |
| TW | 201018254 | 5/2010 |

OTHER PUBLICATIONS

M. Paajanen et al., "ElectroMechanical Film (EMFi)—a new multipurpose electret material", Sensors and Actuators A, vol. 84, pp. 95-102, Aug. 1, 2000. E. Saarimäki et al., "Novel Heat Durable Electromechanical Film: Processing for Electromechanical and Electret Applications", IEEE Transactions on Dielectrics and Electrical Insulation vol. 13, No. 5, pp. 963-972, Oct. 2006.

Saarimäki et al., "Novel Heat Durable Electromechanical Film: Processing for Electromechanical and Electret Applications", IEEE Transactions on Dielectrics and Electrical Insulation vol. 13, No. 5 (Oct. 2006) 963-972.
Bellini et al., "Non-Linear Digital Audio Processor for Dedicated Loudspeaker Systems", IEEE Transactions on Consumer Electronics, vol. 44, No. 3 (Aug. 1998) 1024-1031.
Bai et al., "Electroacoustic analysis of an electret loudspeaker using combined finite-element and lumped-parameter models", J. Acoust. Soc. Am. 125 (6) (Jun. 2009) 3632-3640.

* cited by examiner

*Primary Examiner* — Calvin Choi
(74) *Attorney, Agent, or Firm* — Jianq Chyun IP Office

(57) ABSTRACT

A flat speaker unit is provided herein. The flat speaker unit includes a first porous electrode, a second porous electrode, and a vibrating membrane with an electret layer disposed there between. In one embodiment, a plurality of supporting members may be configured between the vibrating membrane and the first porous electrode, or between the vibrating membrane and the second porous electrode. In one embodiment, a flat speaker device is provided with at least two flat speaker unit stacked together. By electrically connecting two ends of a signal source respectively to the first and second porous electrodes, or, in another embodiment, electrically connecting one end of the signal source to both of the first and second porous electrodes and connecting another end of the signal source to the vibrating membrane, a sound with low THD is generated accordingly from the flat speaker unit.

27 Claims, 14 Drawing Sheets

FLAT SPEAKER UNIT AND SPEAKER DEVICE THEREWITH

CROSS-REFERENCE TO RELATED APPLICATION

This is a continuation-in-part application of patent application Ser. No. 12/187,381, filed on Aug. 7, 2008, which claims the priority benefit of Taiwan patent application serial no. 96132878, filed on Sep. 4, 2007 and is now pending. This is also a continuation-in-part application of patent application Ser. No. 12/175,467, filed on Jul. 18, 2008, which claims the priority benefit of Taiwan patent application serial no. 96133208, filed on Sep. 6, 2007 and is now pending. This is also a continuation-in-part application of patent application Ser. No. 12/370,598, filed on Feb. 13, 2009, which claims the priority benefits of provisional application No. 61/107,328, filed on Oct. 21, 2008 and Taiwan patent application serial no. 97129296, filed on Aug. 1, 2008 and is now pending. This is also a continuation-in-part application of patent application Ser. No. 12/370,599, filed on Feb. 13, 2009, which claims the priority benefit of provisional application No. 61/107,328, filed on Oct. 21, 2008 and is now pending. This is also a continuation-in-part application of patent application Ser. No. 12/541,145, filed on Aug. 13, 2009, which claims the priority benefits of provisional application No. 61/108,027, filed on Oct. 24, 2008, Taiwan patent application serial no. 98107677, filed on Mar. 10, 2009 and Taiwan patent application serial no. 98117344, filed on May 25, 2009 and is now pending. This is also a continuation-in-part application of patent application Ser. No. 12/759,710, filed on Apr. 14, 2010, which claims the priority benefit of Taiwan patent application serial no. 98126821, filed on Aug. 10, 2009 and is now pending. The entirety of each of the above-mentioned patent applications is hereby incorporated by reference herein and made a part of this specification.

BACKGROUND

1. Technical Field

The disclosure relates to a flat speaker unit and a flat speaker device.

2. Related Art

Vision and audition are two most direct sensory responses of human beings. Thus, scientists have been dedicated to develop various renewable vision and audition related systems. Moving coil speaker is still the major product in the market among all the existing renewable speakers. However, along with people's increasing demand to high quality sensory enjoyment and the ever-decreasing sizes of 3C products (Computer, Communication, and Consumer Electronics), speakers having low power consumption, light weights, and small sizes that are designed according to human engineering, and such speaker can be used in either large-size flat speakers or small walkman headphones and stereo mobile phones, and in a foreseeable future, such technology may have a plenty of demands and application development.

The existing speakers can be categorized into direct and indirect types according to their radiation patterns or can be categorized into moving coil speaker, piezoelectric speaker, and electrostatic speaker according to the driving patterns thereof. The moving coil speaker is currently the most commonly used and most mature product. However, a moving coil speaker cannot be flattened due to a physical structure shortage thereof. Accordingly, moving coil speaker is not suitable for 3C products and home entertainment systems that have a developing trend of flattening.

A piezoelectric speaker pushes a membrane to produce sounds based on a piezoelectric effect of a piezoelectric material (i.e., the material is deformed when an electric field is supplied thereon). Such piezoelectric speaker has a flat and small structure. Main products of the electrostatic speaker in the market include hi-end earphones and loudspeakers. According to the operation principle of a conventional electrostatic speaker, a conductive membrane is clamped between two fixed porous electrode plates to form a capacitor, and by supplying a DC bias to the vibrating membrane and an AC voltage to the two fixed electrode plates, an electrostatic force generated by positive and negative electric fields drives the conductive membrane to vibrate, so as to produce sounds. The conventional electrostatic speaker requires a DC bias of up to hundreds or even thousands voltages, so that a high-price and large-size amplifier is required to be connected, which is a reason why the conventional electrostatic speaker is not popularized.

Audio is a major element in the future applications of flexible electronics. However, the flexible electronics has to have the characteristics of softness, thinness, low driving voltage, and high flexibility. Thus, how to break through the conventional design to fabricate elements having the characteristics required by the flexible electronics has become a major subject.

SUMMARY

The speaker unit of the disclosure has a simple structure, which can be mass-produced according to existing techniques and fabrication processes.

In one of embodiments of the disclosure, a flat speaker unit comprises a first porous electrode, a second porous electrode, a vibrating membrane with an electret layer and an electrode layer disposed therebetween. The first porous electrode comprise a first porous metal thin film and a first porous layer. The second porous electrode comprises a second porous metal thin film and a second porous layer. An air gap is respectively formed between the first porous electrode and the vibrating membrane and between the second porous electrode and the vibrating membrane, so as to produce sounds through forces between the first porous electrode, the second porous electrode and the vibrating membrane.

In one of the embodiments, the first porous metal thin film of the first porous electrode and the second porous metal thin film of the second porous electrode are electrically connected to a first end of a signal source, and the vibrating membrane is electrically connected to a second end of the signal source.

In one of the embodiments, the first porous metal thin film of the first porous electrode, the second porous metal thin film of the second porous electrode and the vibrating membrane are electrically connected to a signal source, and the connection relation is determined according to an electrical property of the electret layer of the vibrating membrane.

In one of the embodiments, the flat speaker unit has a bending curvature to change a directional angle.

In one of the embodiments, the first porous metal thin film layer of the first porous electrode is disposed facing the vibrating membrane, and the first porous layer layer is disposed towards a sound outgoing direction; and the second porous metal thin film of the second porous electrode is disposed facing the vibrating membrane, and the second porous layer is disposed towards a sound outgoing direction.

In one of the embodiments, the first porous layer of the first porous electrode being disposed faces the vibrating membrane, and the first porous metal thin film is disposed towards a sound outgoing direction. The second porous metal thin film of the second porous electrode is disposed facing the vibrating membrane, and the second porous layer is disposed towards a sound outgoing direction.

In one of the embodiments, the first porous layer of the first porous electrode being disposed faces the vibrating membrane, and the first porous metal thin film is disposed towards a sound outgoing direction. The second porous layer of the second porous electrode is disposed facing to the vibrating membrane, and the second porous metal thin film is disposed towards a sound outgoing direction.

In one of the embodiments, the first porous metal thin film of the first porous electrode is disposed facing the vibrating membrane, and the first porous layer is disposed towards a sound outgoing direction. The second porous layer of the second porous electrode is disposed facing the vibrating membrane, and the second porous metal thin film is disposed towards a sound outgoing direction.

In one of the embodiments, the first porous electrode and the second porous electrode are riveted through a rivet and a pad, the first porous electrode and the second porous electrode have a same polarity, and an electrical connection terminal is disposed between the first porous electrode and the second porous electrode.

In one of the embodiments, the first porous electrode and the second porous electrode are riveted through a rivet and a pad, the first porous electrode and the second porous electrode have different polarities, and an electrical insulating layer is disposed between the first porous electrode and the second porous electrode.

In one of the embodiments, an electrode plate is disposed on the electrode layer of the vibrating membrane, the electrode plate comprises a main body and a plurality of finger-type protrusions, and the main body is located on a frame supporter, so that the protrusion is electrically connected to the vibrating membrane. In one of the embodiments, a bonding method of the plurality of the finger-type protrusions and the vibrating membrane is implemented through high temperature lamination of a conductive adhesive or an anisotropic conductive film (ACF).

In one of the embodiments, a plurality of first supporting members are disposed between the first porous electrode and the vibrating membrane, and a plurality of second supporting members are disposed between the second porous electrode and the vibrating membrane.

In one of the embodiments, the first supporting members and the second supporting members respectively comprise a first layout pattern and a second layout pattern, in which the first layout pattern and the second layout pattern are respectively disposed between the first porous electrode and the vibrating membrane, and the second porous electrode and the vibrating membrane. Profiles of the first and second patterns are determined by the electrostatic effect therebetween.

In another embodiment, a flat speaker device comprises at least a first flat speaker unit and a second flat speaker unit, and an isolation structure is disposed between the first flat speaker unit and the second flat speaker unit. The first flat speaker unit comprises a first porous electrode, a second porous electrode, and a first vibrating membrane located there between. The first porous electrode and the second porous electrode respectively comprise a plurality of sound holes, and the first vibrating membrane comprises a first electret layer and a first electrode layer. The second flat speaker unit comprises a third porous electrode, a fourth porous electrode and a second vibrating membrane located there between. The third porous electrode and the fourth porous electrode respectively comprise a plurality of sound holes, and the second vibrating membrane comprises a second electret layer and a second electrode layer.

In another embodiment, a flat speaker device comprises a first porous electrode, a second porous electrode, a first vibrating membrane, a third porous electrode and a second vibrating membrane. The porous electrode comprises a first porous metal thin film and a first porous layer. The second porous electrode comprises a second porous metal thin film and a second porous layer. The first vibrating membrane is located between the first porous electrode and the second porous electrode. The third porous electrode comprises a third porous metal thin film and a third porous layer. The second vibrating membrane is located between the second porous electrode and the third porous electrode.

In order to make the aforementioned and other features of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
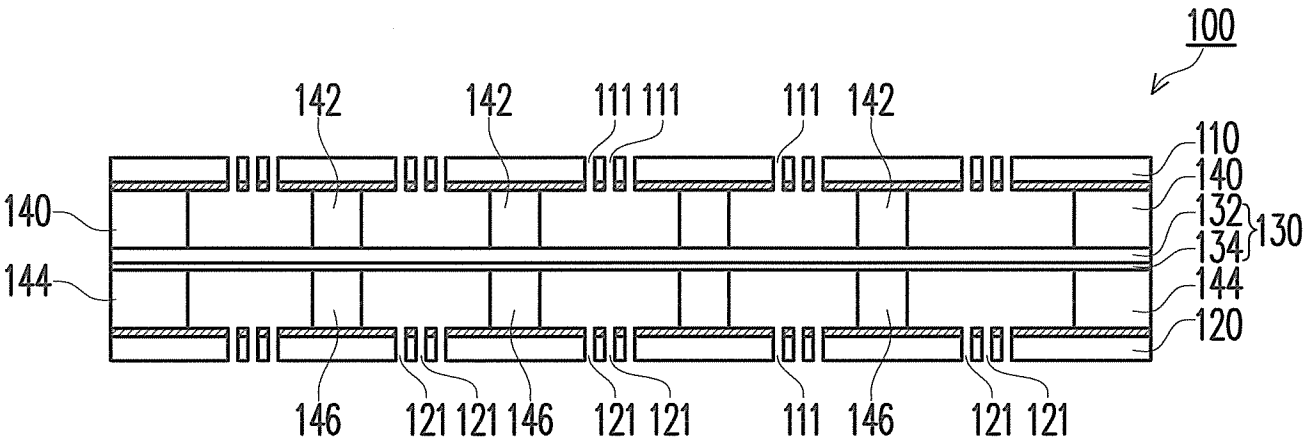
FIG. 1A is a cross-sectional view of a flat speaker unit according to one of a plurality of embodiment of the disclosure.

The disclosure provides a flat speaker unit, which can resolve a problem of a conventional technique that a speaker structure and a driving circuit thereof are too complicated when a sound-pressure power is increased, and improve design and application diversity of the product. The flat speaker unit of the disclosure has a simple structure, which can be mass-produced according to existing techniques and fabrication processes.

In the flat speaker unit or the flat speaker device of the disclosure, two ends of a signal source are electrically connected to porous electrodes and/or a vibrating membrane in the flat speaker unit, so as to drive the flat speaker unit or the flat speaker device to produce sounds to achieve a low Total Harmonic Distortion (THD) effect.

One of the embodiments provides a flat speaker unit including a first porous electrode, a second porous electrode and a vibrating membrane with an electret layer and an electrode layer disposed there between. An air gap suitable for producing sounds is formed between the first porous electrode and the vibrating membrane, or between the second porous electrode and the vibrating membrane.

In an embodiment, a plurality of supporting members are disposed between the first porous electrode and the vibrating membrane, or/and between the second porous electrode and the vibrating membrane.

In an embodiment, the flat speaker unit is fixed by a frame supporter, and the first porous electrode, the second porous electrode and the vibrating membrane having the electret layer and the electrode layer are stacked inside the frame supporter, wherein a plurality of supporting members are added therein, and the supporting members can be designed to have certain patterns according to actual requirements.

An embodiment of the disclosure provides a flat speaker device, which includes a plurality of the aforementioned flat speaker units, wherein the flat speaker units are at least stacked into a two-layer structure.

In one of the embodiments, the first and the second porous electrodes respectively include a conductive layer and a non-conductive layer, where relative stacking positions of the conductive layer and the non-conductive layer of the first or the second porous electrode can be arbitrarily combined. Or, the first and the second porous electrodes both include a conductive layer.

In an embodiment, at least one of the non-conductive layer faces to the vibrating membrane in the stacking structure. For example, the conductive layer of the first porous electrode faces outwards, and the non-conductive layer thereof faces to the vibrating membrane. Now, the conductive layer of the second porous electrode can face outwards or face to the vibrating membrane. Such design is because that a thickness of the fat speaker unit is rather thin, and when the first and the second porous electrodes and the vibrating membrane vibrate to make sounds, the electrode layer of the electret layer probably contacts the first or the second porous electrode to cause short circuit due to vibration of the electret layer.

An embodiment of the disclosure provides a flat speaker device formed by one or a plurality of flat speaker units of the aforementioned embodiments. By respectively connecting audio signals of different polarities to the first and second porous electrodes, or in another embodiment, connecting the audio signal of the same polarity to the first and second porous electrodes and connecting the audio signal of another polarity to the vibrating membrane including the electret layer, the vibrating membrane having the electret layer is vibrated to drive the flat speaker device to make sounds. For example, when a first end of a signal source is connected to the first porous electrode, a second end of the signal source is connected to the second porous electrode. The signals with positive and negative polarities of the signal source are alternately connected to the first and the second porous electrodes through the first and the second ends, and based on charge characteristics of the electret layer of the vibrating membrane, the vibrating membrane is vibrated to push the air in the air gap to produce corresponding sounds. In another embodiment, signals of different polarities can be applied to the first and second porous electrodes or the vibrating membrane to produce sounds.

The above connection method is to achieve a low THD, i.e. reduce the THD phenomenon.

Electret Material

In the aforementioned flat speaker unit, based on the charge characteristics and an electrostatic effect of the electret material, when the electret vibrating membrane is stimulated by an external voltage, a surface of the vibrating membrane is deformed, so as to drive the air surrounding the vibrating membrane to produce sound. As known from an electrostatic force formula and energy laws, the force applied on the vibrating membrane equals to the capacitance of the whole speaker multiplied by an intensity of an internal electric field and a sound voltage signal input from external, and the larger the force applied on the electret vibrating membrane is, the louder the output sound is.

The speaker unit of the disclosure has a simple structure, which can be mass-produced according to the existing techniques and fabrication processes, so that fabrication cost thereof can be effectively reduced. The embodiment enhances reliability and the sounding efficiency of the flat speaker, which is one of techniques the flat speaker. Regarding a constitution of the flat speaker unit, a flexible speaker unit with flexible and bendable characteristics can be used. Certainly, materials whose characteristics remain unaffected in a bended state should be applied.

Based on the charge characteristics and the electrostatic effect of the electret material, when the electret vibrating membrane is stimulated by the external voltage, deformation vertical to the surface of the vibrating membrane is generated. Namely, if four sides of the vibrating membrane are fixed, deformation parallel to the surface of the vibrating membrane is avoided, and the deformation vertical to the surface of the vibrating membrane is generated, so as to drive the air around the vibrating membrane to generate sound. As known from the electrostatic force formula and the energy laws, the force applied on the vibrating membrane equals to the capacitance of the whole speaker multiplied by an intensity of an internal electric field and a sound voltage signal input from external, and the larger the force applied on the electret vibrating membrane is, the louder the output sound is, and a principle thereof is described later.

According to the Coulomb's Law, a product of charges of two charged objects is directly proportional to an electrostatic force interacted there between, and inversely proportional to a square of a distance between the two objects. If the two charges are both positive or negative, the objects are repelled by a repulsive electrostatic force. If one of the charges is positive, and the other is negative, the objects are attracted by an attractive electrostatic force. The electret material utilized in the flat speaker unit of the embodiment is an electret composite material electro-sound actuator having micro-scale or nano-scale pores. In the flat speaker unit, an electret vibrating membrane is clamped symmetrically or asymmetrically between two charged porous electrode plates, which has a structure similar to that of a capacitor, and the porous electrode plates are respectively applied with positive and negative voltages (from the signal source). According to the Coulomb's Law, the electret vibrating membrane in the middle is forced by an attractive and a repulsive electrostatic forces at the same time, and the electrostatic force applied on a unit area of the vibrating membrane can be represented by a following equation (1):

$$p = \frac{2V_{in}V_e\varepsilon_0\left(\frac{1}{S_a} + \frac{\varepsilon_e}{S_e}\right)\varepsilon_e S_e}{(S_e + \varepsilon_e S_a)^2} \quad \text{equation (1)}$$

Where, a vacuum permittivity $\in_o$=8.85*10$^{-12}$ F/m, an electret dielectric constant is $\in_e$, a thickness of the electret material is $S_e$, a thickness of an air layer is $S_a$, an input signal voltage is $V_{in}$, a voltage of the electret material is $V_e$, and the electrostatic force applied to a unit area of the vibrating membrane is P. As known from the equation (1), the electrostatic force is directly proportional to a product of the bias and the audio signal voltage, and is inversely proportional to a distance between the porous electrode plate and the electret vibrating membrane. Therefore, in case of a same distance, if the electrostatic speaker can provide a high charge maintaining effect, the audio AC power can achieve the required electrostatic force through a relatively low voltage. In the present embodiment, electret composite materials with micro-scale or nano-scale pores are used to provide a charge maintaining amount of over hundreds to thousands of volts. According to the above electrostatic equation, the audio voltage can be reduced to a dozen of volts, so as to improve the practicality of the flat speaker of the embodiment.

According to the aforementioned principle, under a function of the positive and negative biases of the two porous electrode plates, the electret vibrating membrane is forced by a push-pull electrostatic force, such that the electret vibrating membrane is vibrated to compress the surrounding air to produce sound.

In the embodiment, the electret vibrating membrane can be an electret vibrating membrane that a dielectric material is electrized to be able to keep static charges for a long period of time. Moreover, the electret vibrating membrane is a vibrating membrane manufactured from a single-layered dielectric material or multi-layered dielectric materials, and the dielectric material is, for example, fluorinated hylenepropylene (FEP), polytetrafluoethylene (PTFE), polyvinylidene fluoride (PVDF), partial fluorine-contained polymers, or other suitable materials. The dielectric material may include micro-scale or nanometer-scale pores. Since the electret vibrating membrane is capable of maintaining the static charges for a long time after it is electrized, after corona charging, dipolar charges are generated in the material to generate the electrostatic effect.

Currently, the sound-pressure of the flat speaker unit cannot achieve a sound volume increasing effect in a short period of time due to the materials or design factors thereof, and improvements thereof are all focusing on increasing the charge maintaining amount of the electret vibrating membrane or improving an acoustic structure design. However, the above methods both require time-consuming studies and cannot fulfil an application design requirement of increasing the sound volume within a short time. Therefore, a method of increasing the sound volume through the unit structure design improvement is one of the benefits of the embodiment.

In another embodiment, the flat speaker units are integrated, though the sounding effect of driving a plurality of the flat speaker units can be achieved without changing a design of the input signal source, so as to quickly resolve the problem of material limitation, etc.

Electret Layer Material

In the aforementioned embodiments of the flat speaker unit, to achieve the flexible characteristic, the first and the second porous electrodes or the vibrating membrane can be transparent polymer materials, such as polycarbonate (PC), polyethylene terephthalate (PET), cyclic olefin copolymer (COC), and polymethyl methacrylate (PMMA), etc., and the first and the second porous electrodes can be transparent materials such as indium tin oxide (ITO) or indium zinc oxide (IZO), etc. If the material with a reflection characteristic is required, the metal reflection film such as aluminium, or silver, etc. can be used.

In an embodiment, the first and the second porous electrodes may include a single metal layer having a conductive effect. In another embodiment, the first and the second porous electrodes may also include an insulating layer without a conductive material and a conductive layer with the conductive material.

If the transparent and reflection characteristics are not considered, when the insulating layer is a non-conductive material such as plastic (PET, PC), rubber, paper, or non-conductive cloth (cotton fiber, polymer fiber), etc., the conductive layer can be a pure metal material such as aluminium, gold, silver and copper, etc. or alloys thereof or a dual-metal material such as Ni/Au, or one of ITO and IZO or a combination thereof, or a polymer conductive material PEDOT, etc.

If the first and the second porous electrodes are respectively a single conductive material, it can be one of metal (iron, copper, aluminium or alloys thereof) and conductive cloth (metal fiber, oxide metal fiber, carbon fiber and graphite fiber) or a combination of different conductive materials.

Supporting Members

According to the design of the flat speaker unit of the disclosure, in one of the embodiments, a plurality of supporting members can be added between the first and the second porous electrodes and the vibrating membrane. The supporting members may have various patterns and height variations according to a design requirement, and the supporting members are disposed on the first and the second porous electrodes at the region without the pores.

Distribution of the supporting members may have different designs in allocation method and heights while considering the whole flat speaker unit. A structure design of the supporting member may have different designs in allocation method and heights while considering an audio design. The supporting members can be designed into any shape such as a dot shape, a grating shape, a cross shape or a combination of different shapes, etc., and a distance between the supporting members can be optimally designed according to an actual audio design.

The supporting members can be fabricated on the porous electrodes through transfer printing or decaling, or can be directly fabricated on the porous electrodes according to a printing technique such as inkjet printing or a direct printing method such screen printing, etc. In another embodiment, the supporting members can also be fabricated through a direct adhesion method, for example, the supporting members are first fabricated and then disposed between the first and the second porous electrodes and the vibrating membrane, and the supporting members can be adhered to or not adhered to the vibrating membrane (or the porous electrodes).

In another embodiment, the supporting members can also be fabricated according to an etching process or a photolithography process, or a dispensing process.

In an embodiment, the flat speaker device includes a plurality of the aforementioned flat speaker units. The flat speaker device can be fabricated through a roll to roll processing, by which based on the flexible speaker structure having the electret vibrating membrane, the roll to roll processing is used to break through the conventional production design, and in collaboration with processes such as stamping, die casting and adhesion, the roll-based speaker unit materials are fabricated. In this way, cost of fabricating the speaker units can be greatly reduced, and since the materials can provide large-area and irregular-shape industrial design spaces, it has a considerable application space for future new type application products, which is also an essence of the flexible electronic components.

In an embodiment, a method for manufacturing the flat speaker unit is provided. In the method, a first porous electrode, a second porous electrode, and a vibrating membrane are provided. A conductive layer is formed on the vibrating membrane. A plurality of first supporting members are formed on one of the first porous electrode and the vibrating membrane. A plurality of second supporting members are formed on one of the second porous electrode and the vibrating membrane. The first porous electrode, the second porous electrode and the vibrating membrane are combined to provide a vibrating space between the first porous electrode and the vibrating membrane, and provide another vibrating space between the vibrating membrane and the second porous electrode.

Another method for manufacturing the flat speaker unit is provided. In the method, a conductive layer is formed on the vibrating membrane, and a plurality of first supporting members is formed on one of the first porous electrode and the vibrating membrane. A plurality of second supporting members is formed on one of the second porous electrode and the vibrating membrane. The first porous electrode, the vibrating membrane and the second porous electrode are combined to provide a first vibrating space between the first porous electrode and the vibrating membrane, and provide a second vibrating space between the vibrating membrane and the second porous electrode. In the above method, the first porous electrode, the second porous electrode, and the vibrating membrane are provided in form of roll-based materials. Therefore, at least one of the steps of forming the conductive layer on the vibrating membrane, forming the first supporting members, forming the second supporting members and combining the first porous electrode, the vibrating membrane and the second porous electrode can be performed through the roll to roll processing.

The flat speaker unit with high reliability and applications of the stacking structure of the flat speaker units are described in the following different embodiments, As shown in FIG. 1A, the flat speaker unit 100 is composed of a first porous electrode 110, a second porous electrode 120 and a vibrating membrane 130 with an electret layer 132 and an electrode layer 134 disposed there between. An air gap suitable for producing sound is formed between the first porous electrode 110 and the vibrating membrane 130 or between the second porous electrode 120 and the vibrating membrane 130. In an embodiment, the first porous electrode 110, the second porous electrode 120 and the vibrating membrane 130 can be combined with frame supporters 140 and 144. A plurality of first supporting members 142 are disposed between the first porous electrode 110 and the vibrating film 130 inside the frame supporter 140. A plurality of second supporting members 146 are disposed between the second porous electrode 120 and the vibrating film 130 inside the frame supporter 144. The supporting members 142 and 146 can be designed to have certain patterns according to actual requirements. Namely, a height between the first porous electrode 110 and the vibrating membrane 130 or between the second porous electrode 120 and the vibrating membrane 130 can be designed according to actual design requirements. Moreover, the first and the second supporting members 142 and 146 can also be designed into different heights.

The first porous electrode 110 and the second porous electrode 120 respectively have a plurality of sound holes 111 and 121, where sounds can pass there through. The vibrating membrane 130 includes the electret layer 132 and the electrode layer 134. A method for driving the flat speaker unit 100 is described below.

Pattern structures of the supporting members can resolve the electrostatic effect probably generated between the vibrating membrane and the porous electrodes in the flat speaker unit. For example, the first supporting members 142 between the first porous electrode 110 and the vibrating membrane 130 may have different layout patterns according to different design requirements, which may have different arrangements of geometric shapes according to a degree of the electrostatic effect of the vibrating membrane 130, and the arrangements of the geometric shapes relate to the distances between the supporting members, or the heights of the supporting members, or a shape of the individual supporting members such as a dot shape, a grating shape or a cross shape, etc. The profile of the supporting member itself may have different geometric shapes such as a triangular cylinder, a cylinder or a rectangle, etc.

Figure 1B:
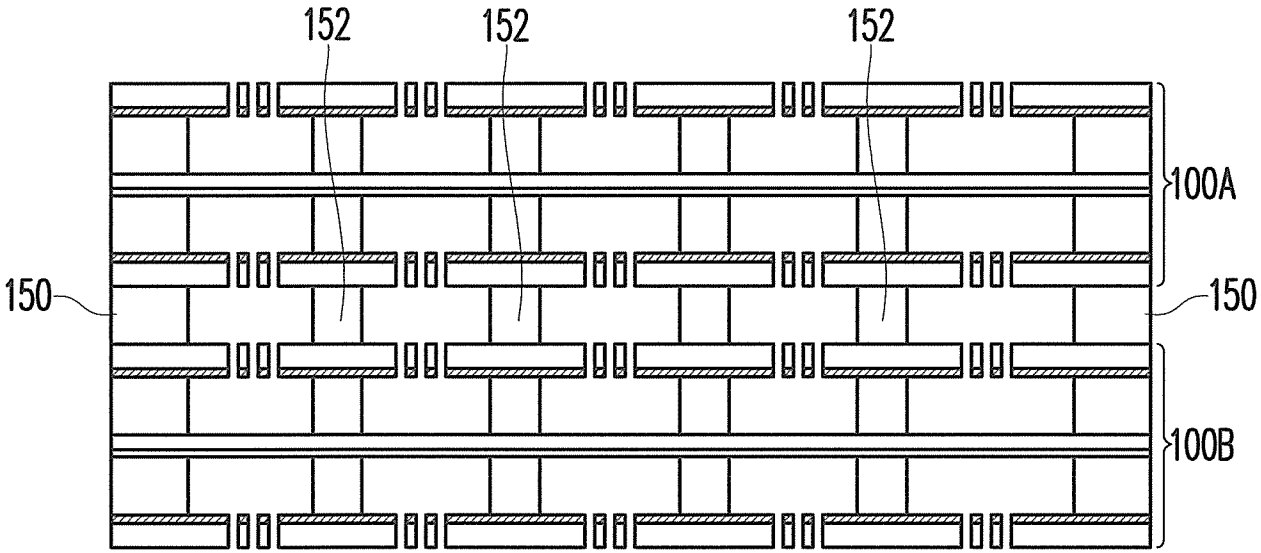
FIG. 1B is a schematic diagram of a flat speaker device stacked by two layers of the flat speaker units of FIG. 1A.

Another embodiment of the disclosure provides a flat speaker device having a plurality of the aforementioned flat speaker units, where the flat speaker units are at least stacked into a two-layer structure. Referring to FIG. 1B, the flat speaker units of FIG. 1A are staked into two layers to form the flat speaker device, for example, flat speaker units 100A and 100B shown in FIG. 1B, and an isolation structure 150 is disposed there between. A plurality of supporting members 152 can also be disposed within the isolation structure 150, and the supporting members 152 are disposed at non-porous areas of the porous electrodes.

As described in the embodiment of FIG. 1A, the pattern structures of the supporting members can resolve the electrostatic effect probably generated between the vibrating membrane and the porous electrodes in the flat speaker unit. Therefore, the flat speaker units 100A and 100B respectively include a plurality of the first supporting members and a plurality of second supporting members, and the first supporting members and the second supporting members respectively include a first layout pattern and a second layout pattern (not shown). Where, the first layout pattern and the second layout pattern are respectively disposed between the first porous electrode and the vibrating membrane, and/or the second porous electrode and the vibrating membrane to adjust the electrostatic effect. The first layout pattern and the second layout pattern are formed according to the shapes of the first supporting members and the second supporting members or allocation positions of the supporting members, for example, distances of the adjacent supporting members or individual height differences, etc.

Referring to FIGS. 2A-2E, FIGS. 2A-2E are cross-sectional views of flat speaker units of a part of embodiments of the disclosure. The flat speaker unit 200 is composed of a first porous electrode 210, a second porous electrode 220 and a vibrating membrane 230 with an electret layer 232 and an electrode layer 234 disposed there between. An air gap suitable for producing sound is formed between the first porous electrode 210 and the vibrating membrane 230 or between the second porous electrode 220 and the vibrating membrane 230. In an embodiment, a plurality of first supporting members 242 are disposed between the first porous electrode 210 and the vibrating film 230 inside a frame supporter 240. A plurality of second supporting members 246 are disposed between the second porous electrode 220 and the vibrating film 230 inside a frame supporter 244. The supporting members 242 and 246 can be designed to have certain patterns according to actual requirements. Namely, a height between the first porous electrode 210 and the vibrating membrane 230 or between the second porous electrode 220 and the vibrating membrane 230 can be designed according to actual design requirements. Moreover, the first and the second supporting members 242 and 246 can also be designed to have different heights. The first porous electrode 210 and the second porous electrode 220 respectively have a plurality of sound holes, where sounds can pass there through, and the vibrating membrane 230 includes the electret layer 232 and the electrode layer 234.

In the embodiments of FIGS. 2A-2E, the first porous electrode and the second porous electrode respectively include a conductive layer and a non-conductive layer, and relative stacking positions of the conductive layers and the non-conductive layers of the porous electrodes can be arbitrarily combined.

Figure 2A:
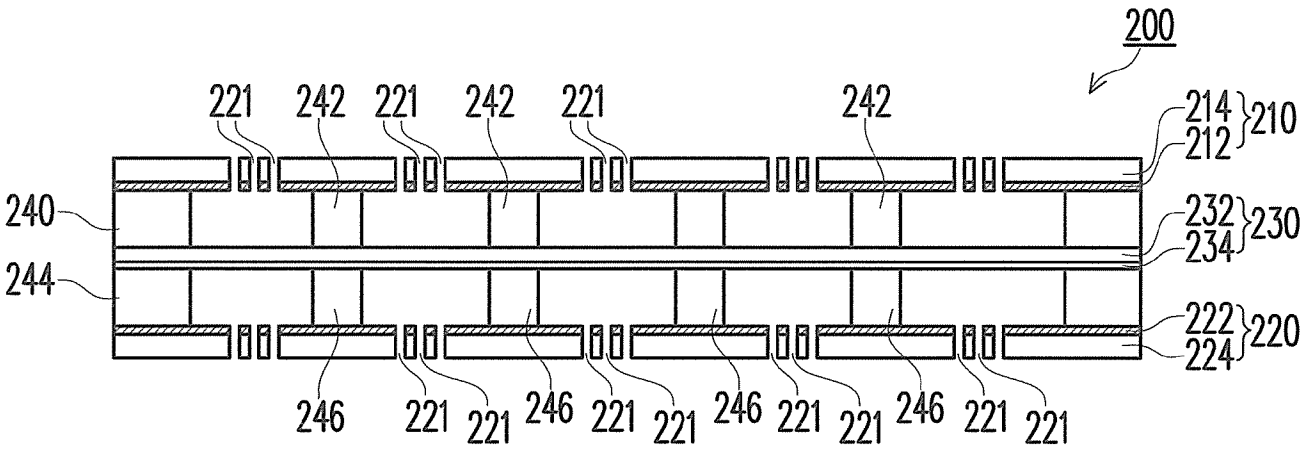
FIGS. 2A-2E are cross-sectional views of flat speaker units of a part of embodiments of the disclosure.
Figure 2B:
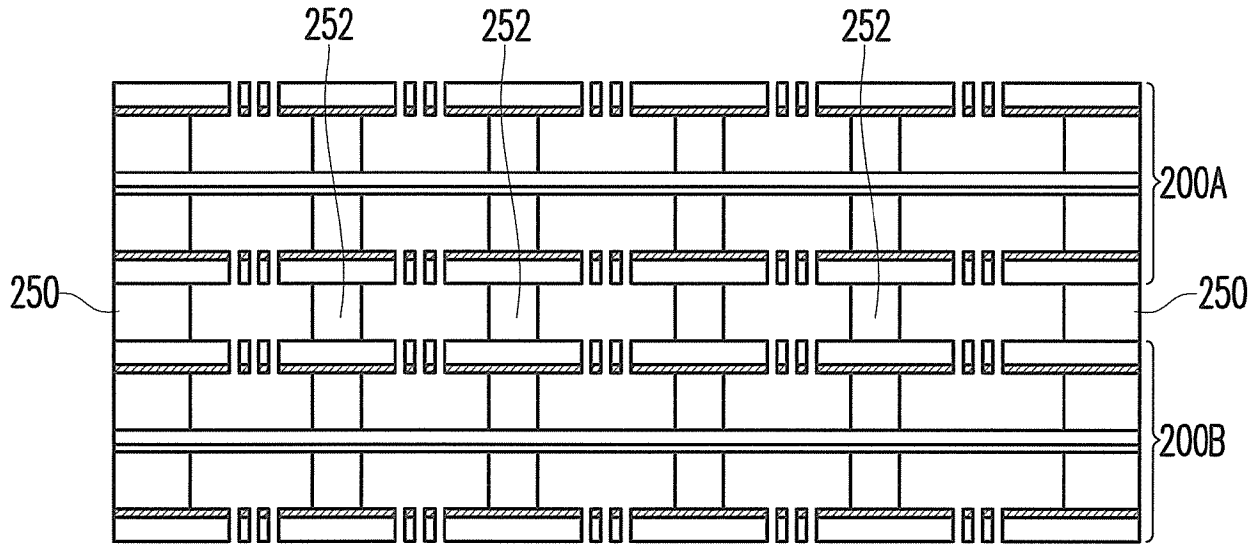

For example, in one of the embodiments, as shown in FIG. 2A, the first porous electrode 210 includes a first porous metal thin film 212 and a first porous layer 214, and the second porous electrode 220 includes a second porous metal thin film 222 and a second porous layer 224. The first porous metal thin film 212 of the first porous electrode 210 faces to the vibrating membrane 230, and the a first porous-layer 214 faces towards a sound outgoing direction. The second porous metal thin film-222 of the second porous electrode 220 faces to the vibrating membrane 230, and the second porous layer 224 faces towards a sound outgoing direction.

An embodiment of the disclosure provides a flat speaker device, which includes a plurality of the aforementioned flat speaker units, wherein the flat speaker units are at least stacked into a two-layer structure.

In one of some embodiment, the first and the second porous electrodes may include an insulating layer and a conductive layer with the conductive material. That is, the first porous layer 214 or the second porous layer 224 may are made of insulating materials. In one of some embodiment, the first porous layer 214 or the second porous layer 224 may include conductive materials or metals, in which the conductive materials or metals are respectively the same with the first porous metal thin film 212 or the second porous metal thin film 222. In other embodiment, the first porous layer 214 or the second porous layer 224 may include conductive materials or metals, which are respectively different from the first porous metal thin film 212 or the second porous metal thin film 222.

In the flat speaker unit of FIG. 2A, the relative stacking positions of the porous layers and the porous metal thin films of the porous electrodes are arbitrarily combined. Two layers of the flat speaker units are stacked to form the flat speaker device, for example, flat speaker units 200A and 200B shown in FIG. 2B, and an isolation structure 250 is selectively disposed there between. A plurality of supporting members 252 can also be disposed within the isolation structure 250. The isolation structure 250 is not a necessity, which can be added or omitted, which are all within the scope of the disclosure.

Figure 2C:
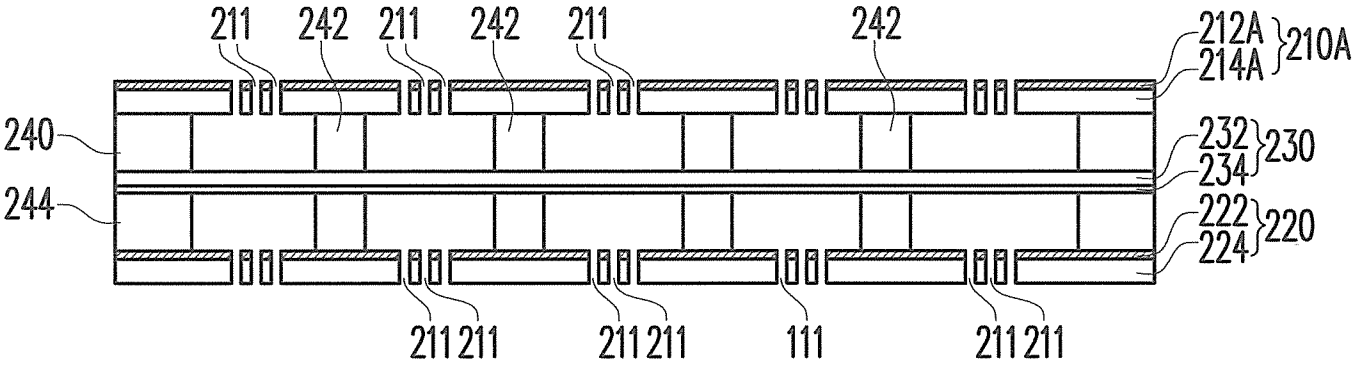

In one of the embodiments shown in FIG. 2C, the structure of FIG. 2C is similar to that of FIG. 2A, though differences there between are as follows. A first porous electrode 210A includes a first porous metal thin film 212A and a first porous layer 214A. The first porous layer 214A of the first porous electrode 210A faces to the vibrating membrane 230, and the first porous metal thin film 212A faces towards a sound outgoing direction. The second porous electrode 220 includes the second porous metal thin film 222 and the porous layer 224. The second porous metal thin film 222 of the second porous electrode 220 faces to the vibrating membrane 230, and the second porous layer 224 faces towards a sound outgoing direction.

Figure 2D:
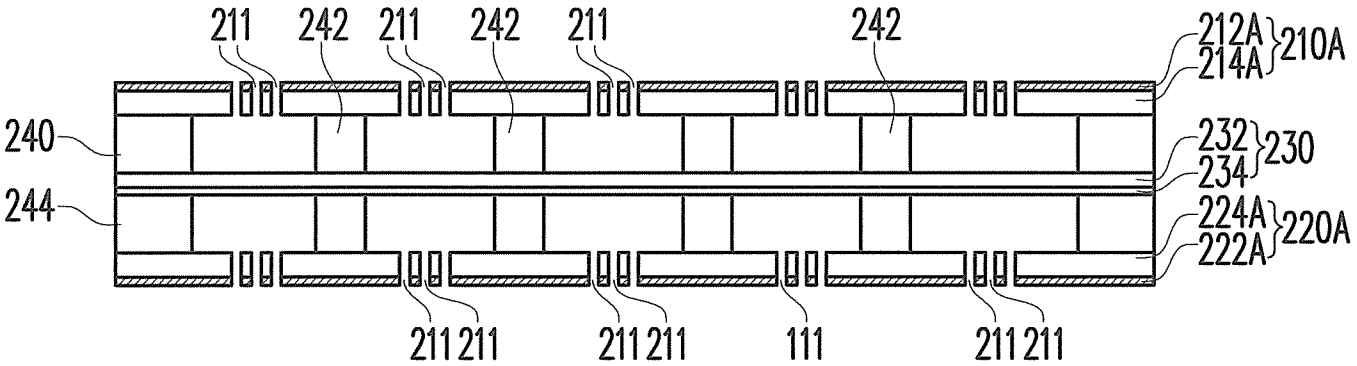
Figure 2E:
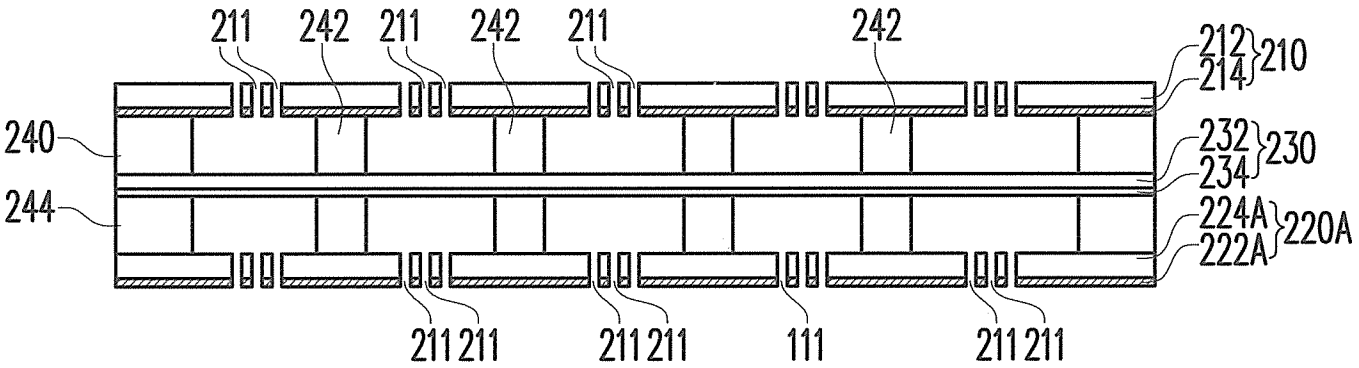

In one of the embodiments shown in FIG. 2D, the structure of FIG. 2D is similar to that of FIG. 2C, though differences there between are as follows. The first porous electrode 210A includes the first porous metal thin film 212A and the first porous layer 214A. A second porous electrode 220A includes a second porous metal thin film 222A and an second porous layer 224A. The first porous layer 214A of the first porous electrode 210A faces to the vibrating membrane 230, and the first porous metal thin film 212A faces towards the sound outgoing direction. The second porous layer 224A of the second porous electrode 220A faces to the vibrating membrane 230, and the second porous metal thin film 222A faces towards the sound outgoing direction. Moreover, the structure of FIG. 2E is similar to that of FIG. 2A, though the difference there between is that the second porous layer 224A of the second porous electrode 220A faces to the vibrating membrane 230, and the second porous metal thin film 222A faces towards the sound outgoing direction.

The flat speaker units of the embodiments of FIGS. 2A-2E can be used to form the flat speaker device, and the flat speaker units are at least stacked into a two-layer structure, where an electrical isolation structure can be disposed between the stacked flat speaker units.

The flat speaker unit used to form the flat speaker device and provided by one of the aforementioned embodiments can be designed into a bending structure, for example, a concave or a convex shape to change a directional angle of the sound sent by the flat speaker device. The concave or the convex shape refers to a whole shape of the flat speaker unit, which includes the porous electrodes, the insulating layer and the vibrating membrane. The concave or the convex shape of the flat speaker unit can be designed according to an electrical property of the electret layer.

Driving Method of the Flat Speaker Unit

Figure 3A:
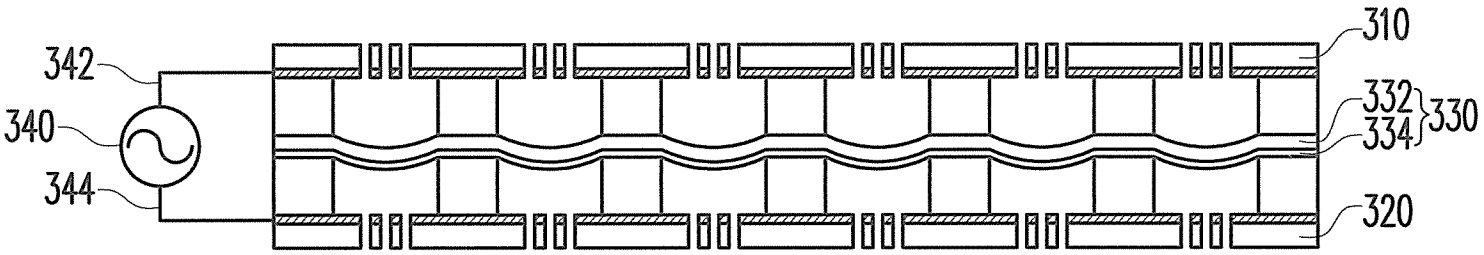
FIG. 3A is a cross-sectional view of a flat speaker unit and a driving signal connection thereof according to one of the embodiments of the disclosure.

FIG. 3A is a cross-sectional view of a flat speaker unit and a driving signal connection thereof according to one of the embodiments of the disclosure. The flat speaker unit is composed of a first porous electrode 310, a second porous electrode 320 and a vibrating membrane 330 with an electret layer 332 and an electrode layer 334 disposed there between. An air gap suitable for producing sound is formed between the first porous electrode 310 and the vibrating membrane 330 or between the second porous electrode 320 and the vibrating membrane 330. A plurality of supporting members are disposed between the first porous electrode 310 and the vibrating film 330. The vibrating membrane 330 includes the electret layer 332 and the electrode layer 334.

In the present embodiment, based on the charge characteristics and the electrostatic effect of the electret material, where the vibrating membrane can be an electret composite material, and positive charges and negative charges can be injected thereon to achieve different effects. A coupling relation between a signal source 340 and the flat speaker unit is determined according to an electrical property of the electret layer 332. For example, in an embodiment, the electret layer 332 of the vibrating membrane has the negative charges, and a coupling method of the signal source 340 used for providing the sound source is as that shown in FIG. 3A, by which one end 342 of the signal source 340 is connected to the first porous metal thin film of the first porous electrode 310, and another end 344 of the signal source 340 is connected to the second porous metal thin film of the second porous electrode 320.

When the positive voltage of the signal source 340 is transmitted to the first porous electrode 310, an attractive force is generated between the positive voltage on the first porous electrode 310 and the negative charges on the vibrating membrane 330. Moreover, when the negative voltage of the signal source 340 is transmitted to the second porous electrode 320, a repulsive force is generated between the negative voltage on the second porous electrode 320 and the negative charges on the vibrating membrane 330. Therefore, the vibrating membrane 330 bends towards the air gap between the first porous electrode 310 and the vibrating membrane 330. Similarly, when the positive voltage of the signal source 340 is transmitted to the second porous electrode 320, an attractive force is generated between the positive voltage on the second porous electrode 320 and the negative charges on the vibrating membrane 330. When the negative voltage of the signal source 340 is transmitted to the first porous electrode 310, a repulsive force is generated between the negative voltage on the first porous electrode 310 and the negative charges on the vibrating membrane 330. As a result, the vibrating membrane 330 bends towards the air gap between the second porous electrode 320 and the vibrating membrane 330, as that shown in FIG. 3A.

In the flat speaker unit of the present embodiment, based on the charge characteristics and the electrostatic effect of the electret material, when the vibrating membrane 330 having the electret layer is stimulated by an external voltage, a deformation vertical to the surface of the vibrating membrane is generated. Namely, if the four sides of the vibrating membrane 330 are fixed, deformation parallel to the surface of the vibrating membrane is avoided, and the deformation vertical to the surface of the vibrating membrane is generated, so as to drive the air around the vibrating membrane 330 to generate sound. The audio signals with alternating phases provided by the signal source 340 can drive the flat speaker unit to produce sounds with different frequencies and/or volumes by varying directions of the forces exerted on the vibrating membrane 330 (the attractive force or the repulsive force).

Figure 3B:
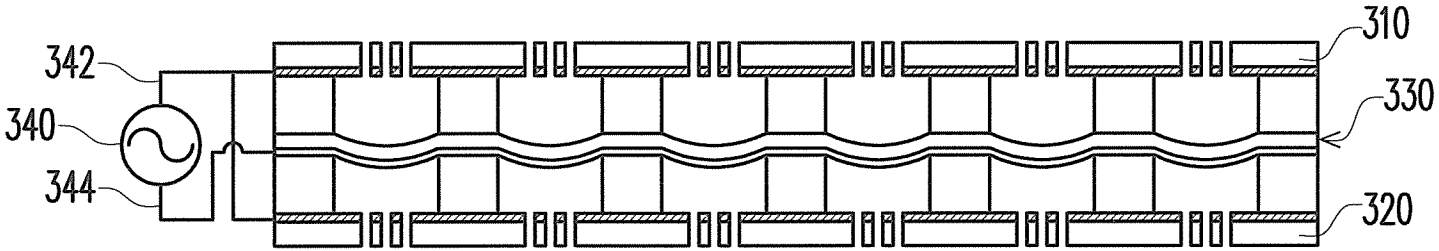
FIG. 3B is a cross-sectional view of a flat speaker unit and a driving signal connection thereof according to another one of the embodiments of the disclosure.

FIG. 3B is a cross-sectional view of a flat speaker unit and a driving signal connection thereof according to another one of the embodiments of the disclosure. The flat speaker unit of the present embodiment is the same to that of FIG. 3A, and a difference there between lies in a connection method of the signal source 340. As shown in FIG. 3B, one end 342 of the signal source 340 is simultaneously connected to the first porous metal thin film of the first porous electrode 310 and the second porous metal thin film of the second porous electrode 320, and another end 344 of the signal source 340 is connected to the vibrating membrane 330.

When the positive voltage of the signal source 340 is transmitted to the first porous electrode 310 and the second porous electrode 320, the negative voltage of the signal source 340 is simultaneously transmitted to the vibrating membrane 330 to strengthen the negative charge effect of the vibrating membrane 330, so as to cause an up and down vibration of the vibrating membrane 330. When the four sides of the vibrating membrane 330 having the electret layer are fixed, deformation parallel to the surface of the vibrating membrane is avoided, and the deformation vertical to the surface of the vibrating membrane is generated, so that the audio signals with alternating phases provided by the signal source 340 can drive the flat speaker unit to produce sounds with different frequencies and/or volumes by varying directions of the forces exerted on the vibrating membrane 330.

Figure 3C:
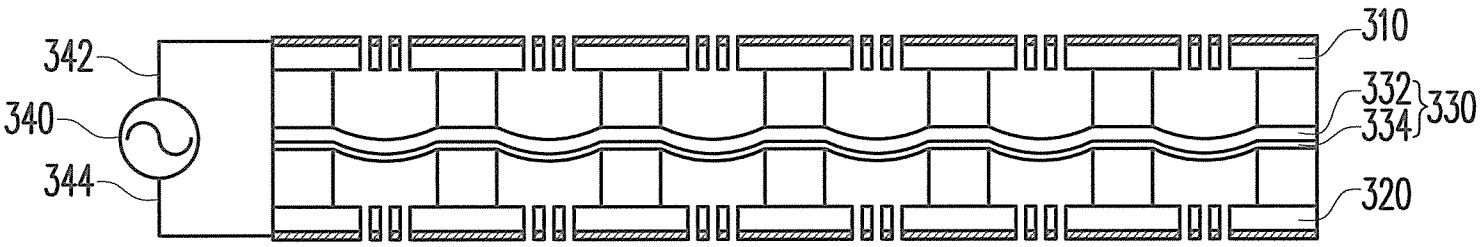
FIG. 3C is a cross-sectional view of a flat speaker unit and a driving signal connection thereof according to further one of the embodiments of the disclosure.

FIG. 3C is a cross-sectional view of a flat speaker unit and a driving signal connection thereof according to further one of the embodiments of the disclosure. The flat speaker unit of the present embodiment is different from that of FIG. 3A. The first porous metal thin film of the first porous electrode 310 and the second the porous metal thin film of the second porous electrode 320 respectively faces the vibrating membrane 330. In the embodiment, one end 342 of the signal source 340 is connected to the first porous metal thin film of the first porous electrode 310, and another end 344 of the signal source 340 is connected to the second porous metal thin film of the second porous electrode 320.

Figure 3D:
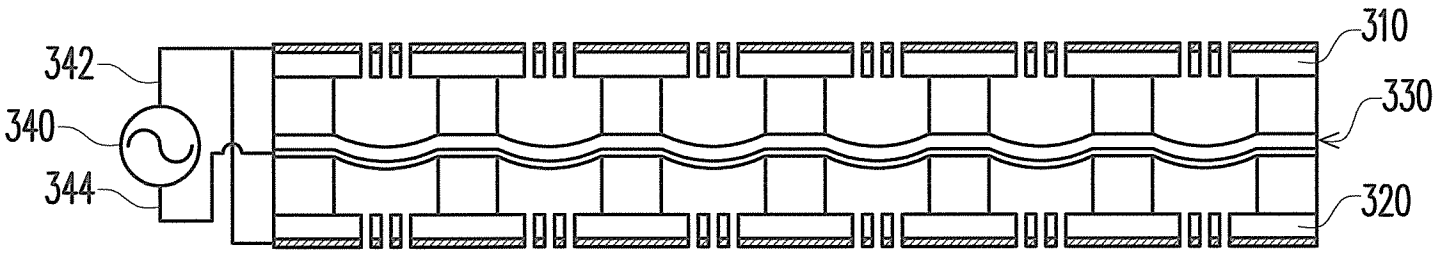
FIG. 3D is a cross-sectional view of a flat speaker unit and a driving signal connection thereof according to further one of the embodiments of the disclosure.

FIG. 3D is a cross-sectional view of a flat speaker unit and a driving signal connection thereof according to further one of the embodiments of the disclosure. The flat speaker unit of the present embodiment is different from that of FIG. 3B. The first porous metal thin film of the first porous electrode 310 and the second the porous metal thin film of the second porous electrode 320 respectively faces the vibrating membrane 330. In the embodiment, one end 342 of the signal source 340 is connected to the first porous metal thin film of the first porous electrode 310 and the second porous metal thin film of the second porous electrode 320. Another end 344 of the signal source 340 is connected to the electrode layer 334 of the vibrating membrane 330.

Figure 4:
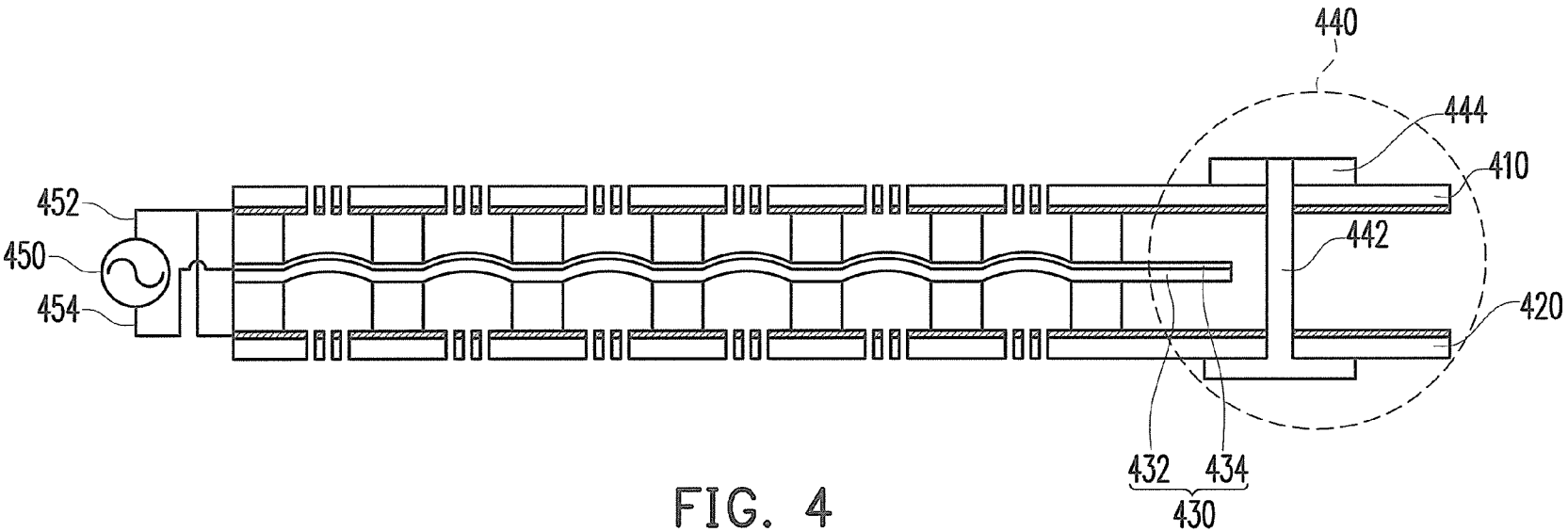
FIG. 4 is a cross-sectional view of a flat speaker unit and a connection of porous electrodes thereof according to one of the embodiments of the disclosure.

Referring to FIG. 4, FIG. 4 is a cross-sectional view of a flat speaker unit and a connection of porous electrodes thereof according to one of the embodiments of the disclosure. The flat speaker unit is composed of a first porous electrode 410, a second porous electrode 420 and a vibrating membrane 430 with an electret layer 432 and an electrode layer 434 disposed there between. An air gap suitable for producing sound is formed between the first porous electrode 410 and the vibrating membrane 430 or between the second porous electrode 420 and the vibrating membrane 430. A plurality of supporting members is disposed between the first porous electrode 410 and the vibrating film 430. The vibrating membrane 430 includes the electret layer 432 and the electrode layer 434. A signal source connection method of the present embodiment is the same to that of FIG. 3B, by which one end 452 of a signal source 450 is simultaneously connected to the first porous metal thin film of the first porous electrode 410 and the second porous metal thin film of the second electrode 420, and another end 454 of the signal source 450 is connected to the vibrating membrane 430. In the present embodiment, an electrical connection structure 440 is used to connect the first porous electrode 410 and the second porous electrode 420. In the electrical connection structure 440, a rivet 442 is used for electrical connection and fixing. As shown in FIG. 4, the rivet 442 respectively passes through the first porous electrode 410 and the second porous electrode 420 and is fixed on a pad 444.

Figure 5B:
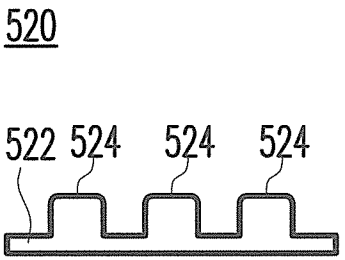
FIGS. 5A and 5B are schematic diagrams illustrating connections between a flat speaker unit of one of the embodiments of the disclosure and electrodes of an external signal source.
Figure 5A:
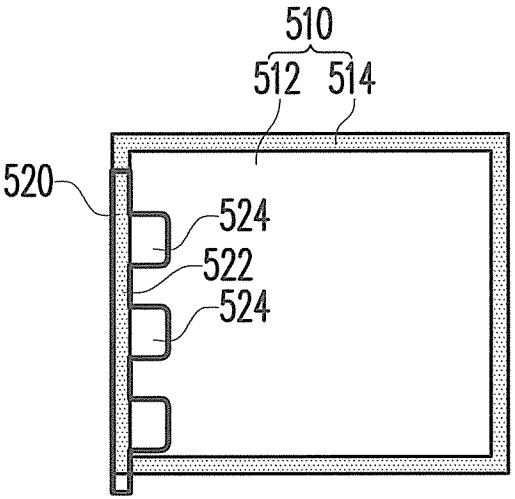

FIGS. 5A and 5B are schematic diagrams illustrating connections between the flat speaker unit of one of the embodiments of the disclosure and electrodes of an external signal source, in which an electrode layer 512 and a frame supporter 514 on the vibrating membrane 510 are illustrated, and the electrode layer 512 is connected to the electrodes of the external signal source. In the present embodiment, an electrode plate 520 including a main body 522 and a plurality of finger-type protrusions 524 is attached to the electrode layer 512, and the main body 522 falls on the frame supporter 514. The finger-type protrusions 524 are electrically bonded to the vibrating membrane 510. The above bonding method is implemented through high temperature lamination of, for example, a conductive adhesive or an anisotropic conductive film (ACF).

Figure 6A:
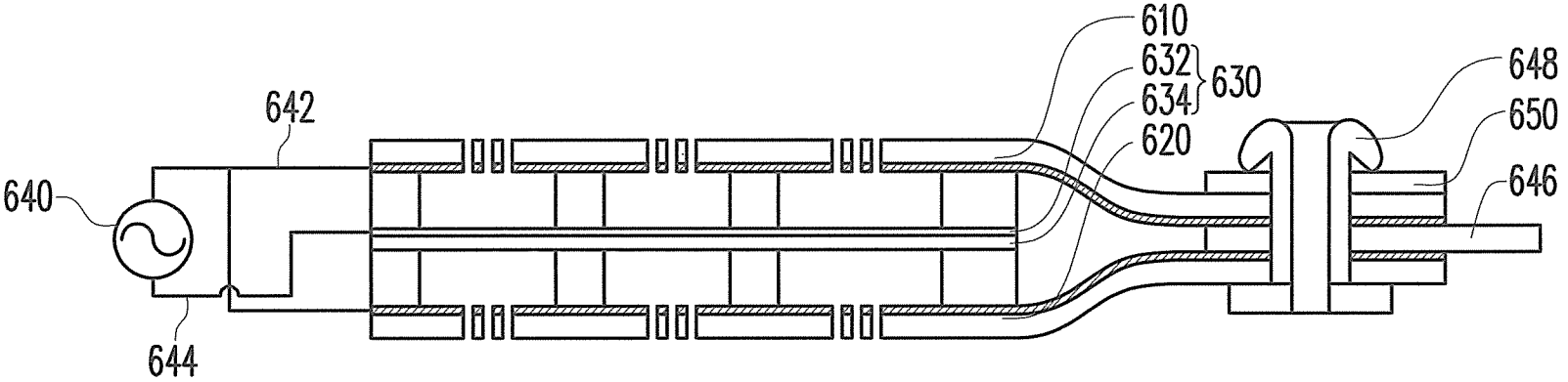
FIGS. 6A and 6B are schematic diagrams illustrating connections between a flat speaker unit of one of the embodiments of the disclosure and electrodes of an external signal source.
Figure 6B:
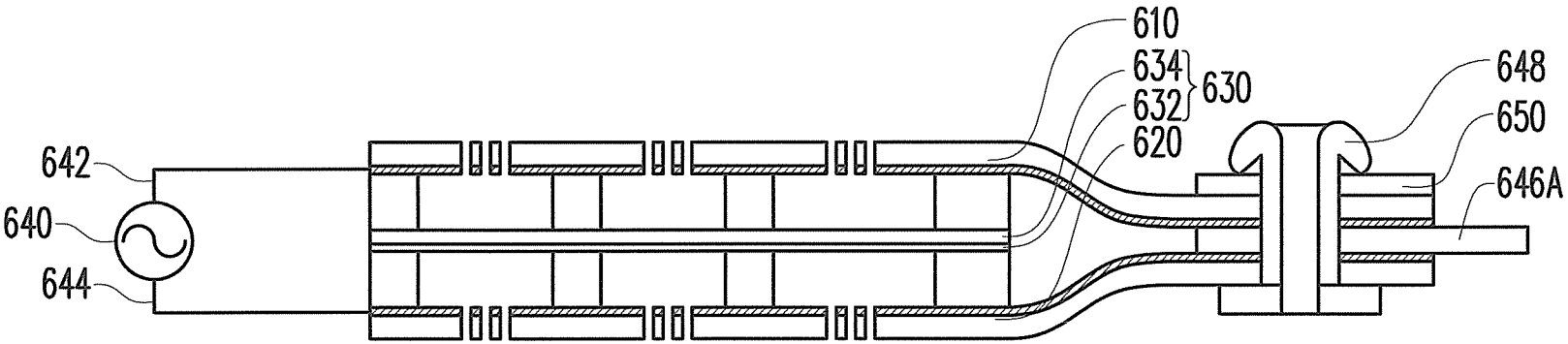

FIGS. 6A and 6B are schematic diagrams illustrating connections between the flat speaker unit of one of the embodiments of the disclosure and electrodes of an external signal source.

Referring to FIGS. 6A and 6B, in which connections between the flat speaker unit of one of the embodiments of the disclosure and electrodes of an external signal source are illustrated. The flat speaker unit is composed of a first porous electrode 610, a second porous electrode 620 and a vibrating membrane 630 located there between. The vibrating membrane 630 includes an electrode layer 632 and an electret layer 634.

In the first embodiment, one end 642 of the signal source 640 is simultaneously connected to the first porous metal thin film of the first porous electrode 610 and the second porous metal thin film of the second porous electrode 620, and another end 644 of the signal source 640 is connected to the vibrating membrane 630, as that shown in FIG. 6A. In the second embodiment, the end 642 of the signal source 640 is connected to the first porous metal thin film of the first porous electrode 610, and the other end 644 of the signal source 640 is connected to the second porous metal thin film of the second porous electrode 620, as that shown in FIG. 6B.

In the first embodiment, the signal source 640 is electrically connected to the first porous electrode 610 and the second porous electrode 620, as shown in FIG. 6A, a rivet 648 is used for electrically connection and fixing. The rivet 648 penetrates through the porous electrodes (for example, 610 and 620) and an electrical connection terminal 646 and is fixed on a pad 650 for riveting.

In the second embodiment, according to a connection method shown in FIG. 6B, two ends of the signal source 640 with different polarities are respectively connected to the first porous electrode 610 and the second porous electrode 620, as shown in FIG. 6B, and the rivet 648 is used for electrical connection and fixing. The rivet 648 penetrates through the first porous electrode 610, the second porous electrode 620 and an electrical insulating layer 646A and is fixed on the pad 650 for riveting. The first porous electrode 610 and the second porous electrode 620 are electrically isolated.

Flat Speaker Device Stacked with a Plurality of Flat Speaker Units

The flat speaker device with high reliability provided by the disclosure can be formed by the aforementioned flat speaker units assembled in different combinations, and in case that the design of the input signal source is not changed, the ends thereof with positive and negative polarities are adjusted to drive the flat speaker units to produce sounds.

In the following, a flat speaker device stacked by a plurality of flat speaker units with high reliability is described according to different embodiments.

Referring to FIGS. 7A-7D, FIGS. 7A and 7D are schematic diagrams illustrating a flat speaker device and different driving signal connections according to an embodiment of the disclosure. The flat speaker device includes a plurality of flat speaker units, where the flat speaker units are at least stacked into a two-layer structure. An isolation structure is disposed on one of the sacked flat speaker units, though the isolation structure is not a necessity, which can be added or omitted, which are all within the scope of the disclosure. A plurality of supporting members can be disposed in the isolation structure.

The isolation structure can be an insulating material when the adjacent porous electrodes have different polarities. However, when the adjacent porous electrodes have the same polarity, the isolation structure can be omitted, or the isolation structure can be a conductor.

Figure 7A:
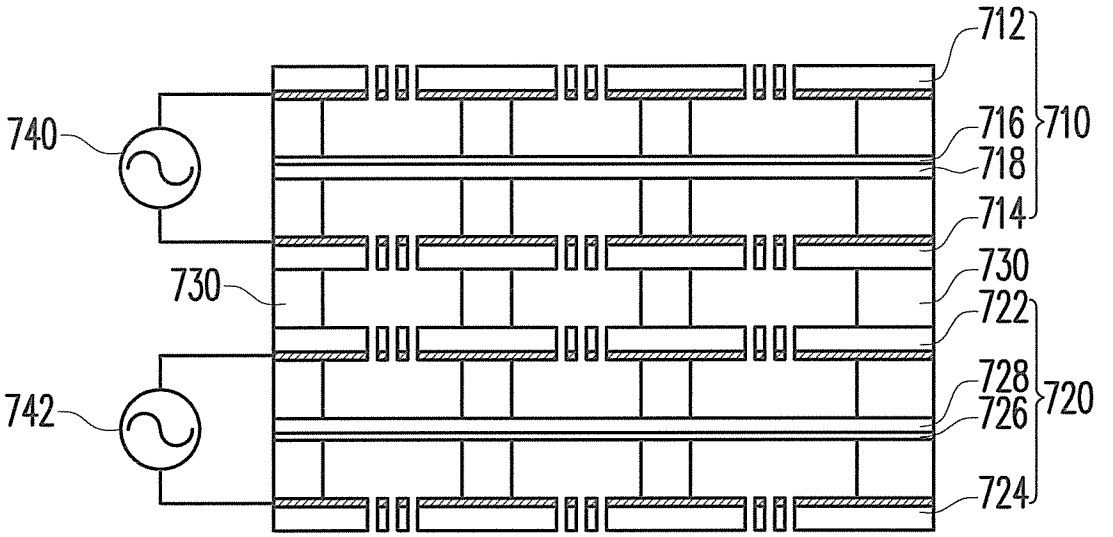
FIGS. 7A-7D are schematic diagrams illustrating a flat speaker device and different driving signal connections according to an embodiment of the disclosure.

As shown in FIG. 7A, the flat speaker device having the stacking structure includes a first flat speaker unit 710 of the upper layer, the isolation structure 730, and a second flat speaker unit 720 of the lower layer. The first flat speaker unit 710 of the upper layer is composed of a first porous electrode 712, a second porous electrode 714 and a first vibrating membrane with a first electrode layer 716 and a first electret layer 718 disposed there between. The first porous electrode 712 faces to the first electrode layer 716, and the second porous electrode 714 faces to the first electret layer 718.

The second flat speaker unit 720 of the lower layer is composed of a third porous electrode 722, a fourth porous electrode 724 and a second vibrating membrane with a second electret layer 728 and a second electrode layer 726 disposed there between. The third porous electrode 722 faces to the second electret layer 728, and the fourth porous electrode 724 faces to the second electrode layer 726. In the above stacking method, while considering allocation positions of the electret layers and the electrode layers and connection methods of the signal sources, a following condition has to be satisfied: when the multiple vibrating films are vibrated, vibration phases thereof have to be consistent.

A first end of a first signal source 740 is connected to a first porous metal thin film of the first porous electrode 712 of the first flat speaker unit 710, and a second end of the first signal source 740 is connected to a second porous metal thin film of the second porous electrode 714. A first end of a second signal source 742 is connected to a third porous metal thin film of the third porous electrode 722 of the second flat speaker unit 720, and a second end of the second signal source 742 is connected to the fourth porous metal thin film of the fourth porous electrode 724.

According to the above connecting method, when the first end of the first signal source 740 or the second signal source 742 provides a signal of a first polarity, the second end thereof provides the signal of a second polarity, where the first polarity and the second polarity are inversed. The first signal source 740 or the second signal source 742 provides AC signals, which alternately outputs the signal with different polarities through the first end and the second end.

Figure 7B:
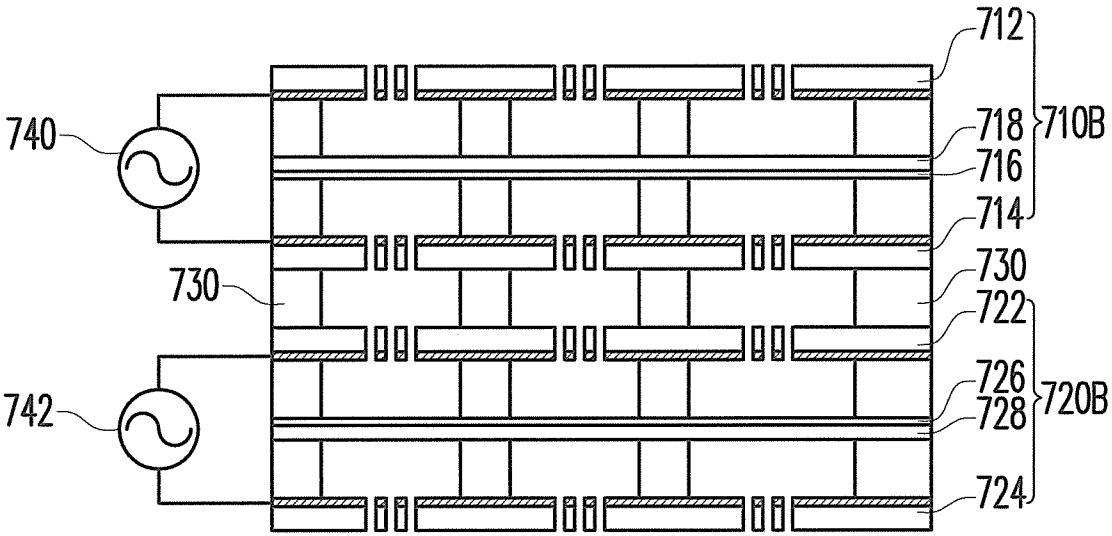

The flat speaker device having the stacking structure of FIG. 7B is similar to the structure of FIG. 7A, and a difference there between lies in the positions of the electrode layers and the electret layers in the vibrating membranes. In a first flat speaker unit 710B of the upper layer, the first porous electrode 712 faces to the first electret layer 718, and the second porous electrode 714 faces to the first electrode layer 716. In a second flat speaker unit 720B of the lower layer, the third porous electrode 722 faces to the second electrode layer 726, and the fourth porous electrode 724 faces to the second electret layer 728.

Figure 7C:
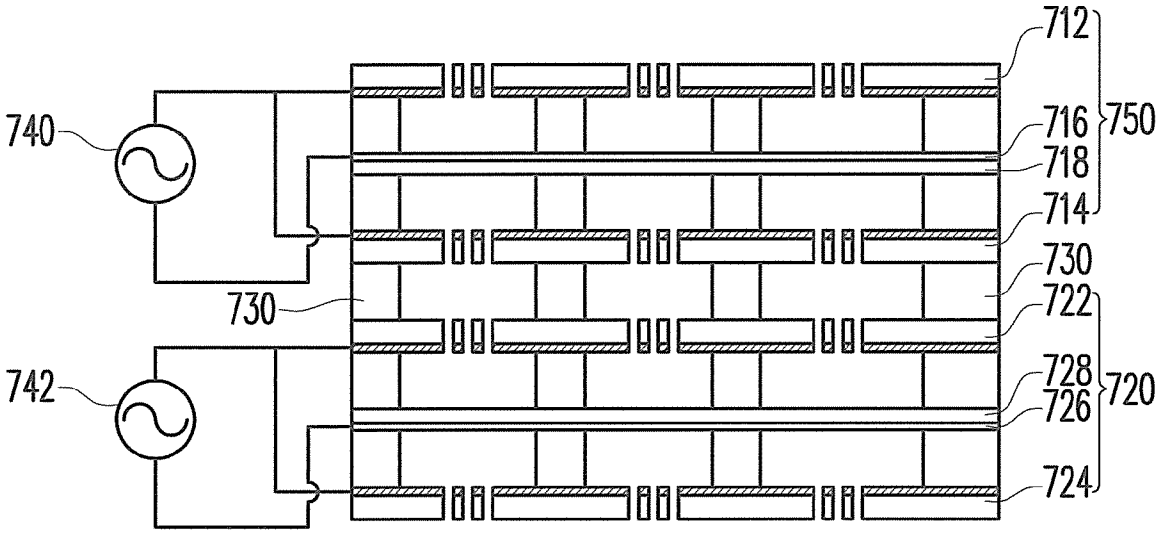

The flat speaker device having the stacking structure of FIG. 7C is similar to the structure of FIG. 7A, though driving connection methods thereof are different. The first end of the first signal source 740 is connected to a first porous metal thin film of the first porous electrode 712 and a second porous metal thin film of the second porous electrode 714 of the first flat speaker unit 710, and the second end of the first signal source 740 is connected to the first electrode layer 716 of the first vibrating membrane. The first end of the second signal source 742 is connected to a third porous metal thin film of the third porous electrode 722 and a fourth porous metal thin film of the fourth porous electrode 724 of the second flat speaker unit 720, and the second end of the second signal source 742 is connected to the second electrode layer 726 of the second vibrating membrane.

According to the above connecting method, when the first end of the first signal source 740 or the second signal source 742 provides a signal of the first polarity, the second end thereof provides the signal of the second polarity, where the first polarity and the second polarity are inversed. The first signal source 740 or the second signal source 742 provides AC signals, which alternately outputs the signal with different polarities through the first end and the second end.

Figure 7D:
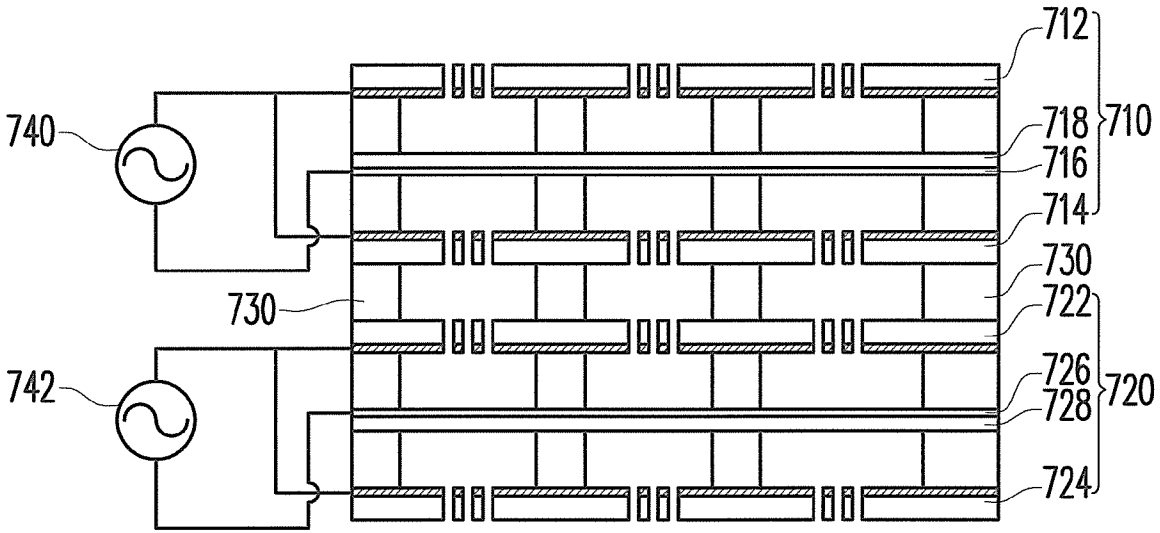

The flat speaker device having the stacking structure of FIG. 7D is similar to the structure of FIG. 7B, though driving connection methods thereof are different. The first end of the first signal source 740 is connected to a first porous metal thin film of the first porous electrode 712 and a second porous metal thin film of the second porous electrode 714 of the first flat speaker unit 710, and the second end of the first signal source 740 is connected to the first electrode layer 716 of the first vibrating membrane. The first end of the second signal source 742 is connected to a first porous metal thin film of the third porous electrode 722 and a fourth porous metal thin film of the fourth porous electrode 724 of the second flat speaker unit 720, and the second end of the second signal source 742 is connected to the second electrode layer 726 of the second vibrating membrane.

Referring to FIGS. 8A-8F, FIGS. 8A-8F are schematic diagrams illustrating a flat speaker device and different driving signal connections according to an embodiment of the disclosure. The flat speaker device includes a plurality of flat speaker units, where the flat speaker units share a part of the porous electrodes. The electret material can carry negative charges or positive charges, which is determined according to different stacking structures and signal connection methods.

Figure 8A:
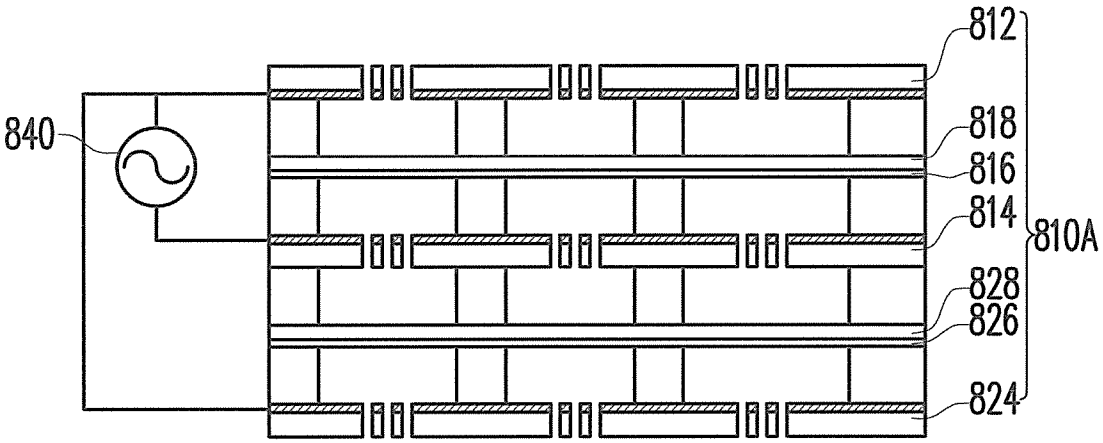
FIGS. 8A-8F are schematic diagrams illustrating a flat speaker device and different driving signal connections according to an embodiment of the disclosure.

The flat speaker device of FIG. 8A includes two stacked flat speaker units sharing a porous electrode. The flat speaker device 810A sequentially includes a first porous electrode 812, a first electret layer 818 and a first electrode layer 816 of a first vibrating membrane, a second porous electrode 814, a second electret layer 828 and a second electrode layer 826 of a second vibrating membrane, and a third porous electrode 824 from top to bottom. One end of a signal source 840 is connected to a second porous metal thin film of the second porous electrode 814 in the middle of the stacking structure, and another end of the signal source 840 is connected to a first porous metal thin film of the first porous electrode 812 and a third porous metal thin film of the third porous electrode 824.

Figure 8B:
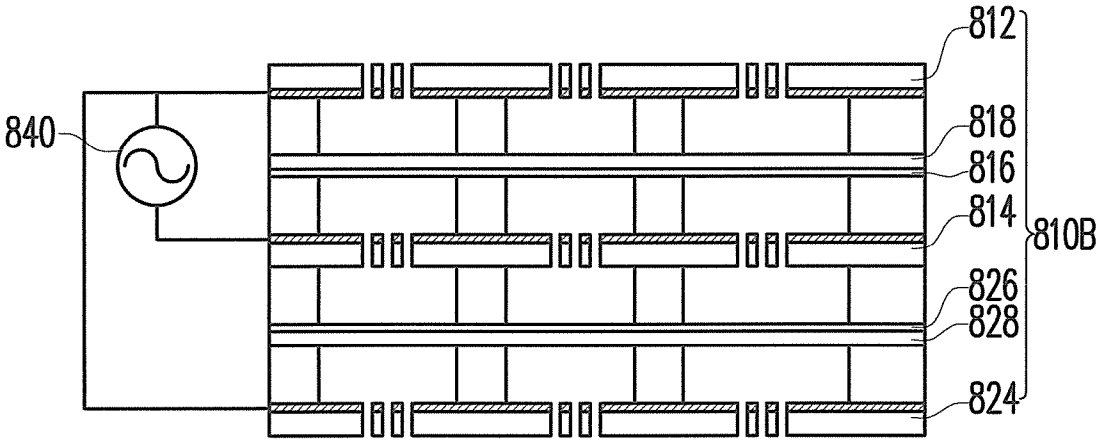

The flat speaker device of FIG. 8B includes two stacked flat speaker units sharing a porous electrode. The stacked flat speaker device 810B is similar to the structure of FIG. 8A, and a difference there between lies in positions of the electrode layer and the electret layer in the vibrating membrane, where the flat speaker device 810B sequentially includes the first porous electrode 812, the first electret layer 818 and the first electrode layer 816 of the first vibrating membrane, the second porous electrode 814, the second electrode layer 826 and the second electret layer 828 of the second vibrating membrane, and the third porous electrode 824 from top to bottom. One end of the signal source 840 is connected to a second porous metal thin film of the second porous electrode 814 in the middle of the stacking structure, and the other end of the signal source 840 is connected to a first porous metal thin film of the first porous electrode 812 and a third porous metal thin film of the third porous electrode 824.

Figure 8C:
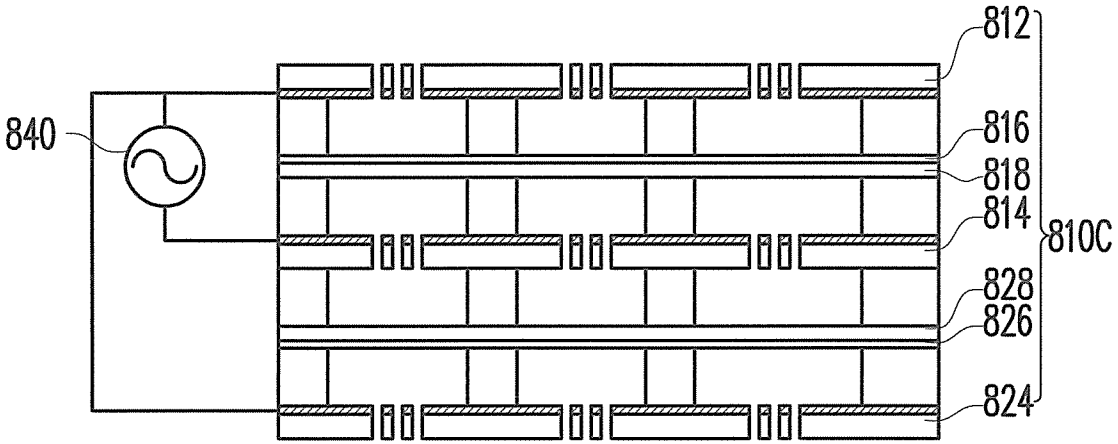

The flat speaker device of FIG. 8C includes two stacked flat speaker units sharing a porous electrode. The stacked flat speaker device 810C is similar to the structure of FIG. 8A, and a difference there between lies in positions of the electrode layers and the electret layers in the vibrating membranes, where the flat speaker device 810C sequentially includes the first porous electrode 812, the first electrode layer 816 and the first electret layer 818 of the first vibrating membrane, the second porous electrode 814, the second electrode layer 826 and the second electret layer 828 of the second vibrating membrane, and the third porous electrode 824 from top to bottom. One end of the signal source 840 is connected to a second porous metal thin film of the second porous electrode 814 in the middle of the stacking structure, and the other end of the signal source 840 is connected to a first porous metal thin film of the first porous electrode 812 and a third porous metal thin film of the third porous electrode 824.

Figure 8D:
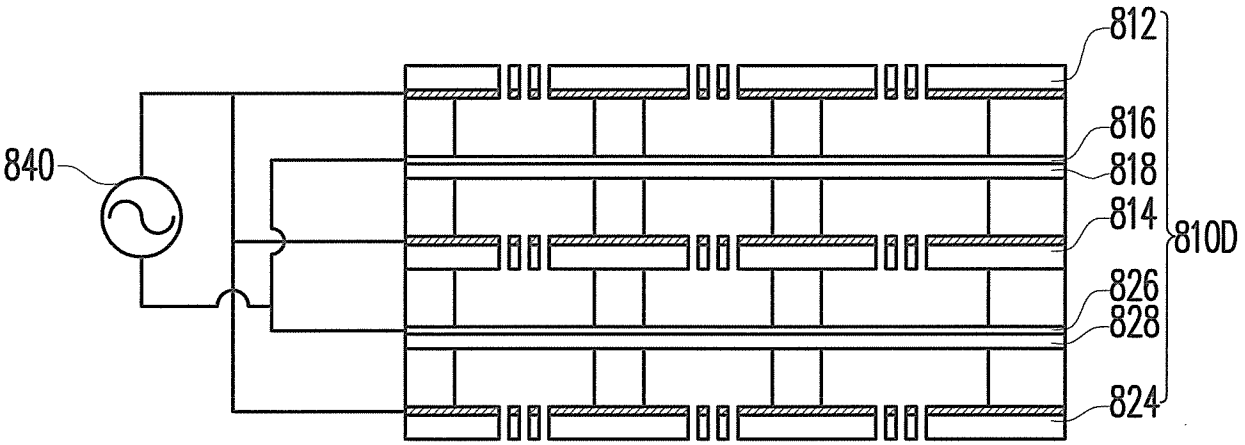

The flat speaker device of FIG. 8D includes two stacked flat speaker units sharing a porous electrode. The stacked flat speaker device 810D is similar to the structure of FIG. 8A, and a difference there between lies in positions of the electrode layer and the electret layer in the vibrating membrane, where the flat speaker device 810D sequentially includes the first porous electrode 812, the first electrode layer 816 and the first electret layer 818 of the first vibrating membrane, the second porous electrode 814, the second electret layer 828 and the second electrode layer 826 of the second vibrating membrane, and the third porous electrode 824 from top to bottom. One end of the signal source 840 is connected to a first porous metal thin film of the first porous electrode 812, a second porous metal thin film of the second porous electrode 814 and a third porous metal thin film of the third porous electrode 824, and the other end of the signal source 840 is connected to the first electrode layer 816 in the first vibrating membrane and the second electrode layer 826 in the second vibrating membrane.

Figure 8E:
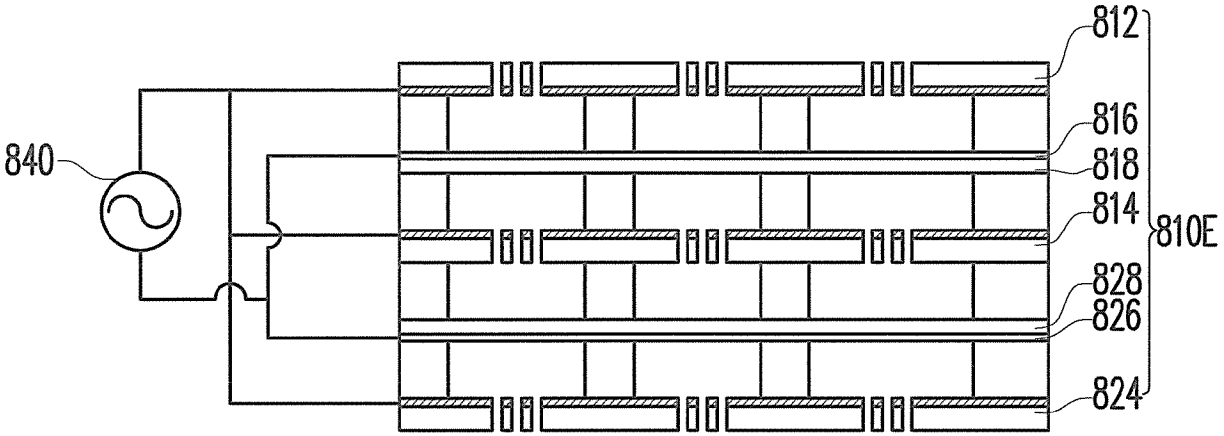

The flat speaker device of FIG. 8E includes two stacked flat speaker units sharing a porous electrode. The stacked flat speaker device 810E is similar to the structure of FIG. 8C, and a difference there between lies in a driving signal connection method. In the present embodiment, one end of the signal source 840 is connected to a first porous metal thin film of the first porous electrode 812, a second porous metal thin film of the second porous electrode 814 and a third porous metal thin film of the third porous electrode 824, and another end of the signal source 840 is connected to the first electrode layer 816 in the first vibrating membrane and the second electrode layer 826 in the second vibrating membrane.

Figure 8F:
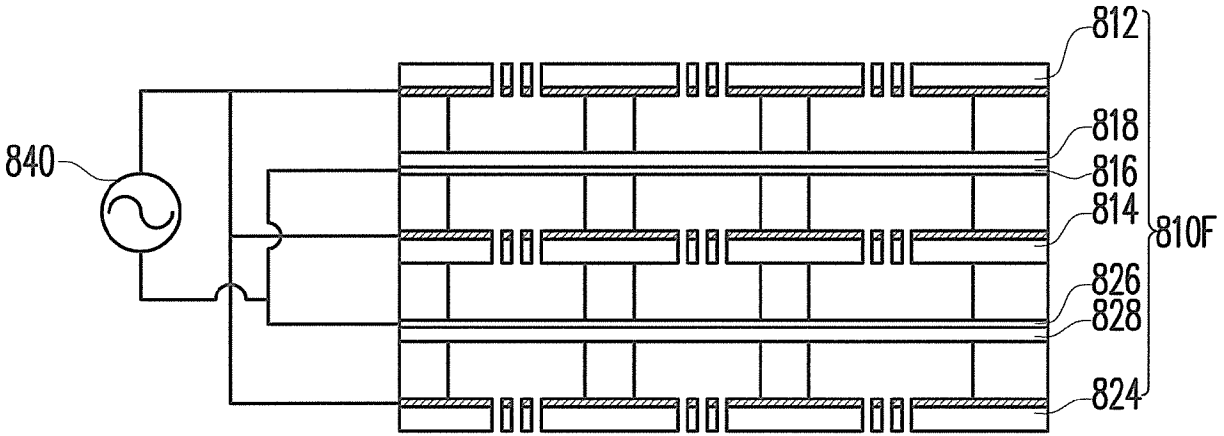

The flat speaker device of FIG. 8F includes two stacked flat speaker units sharing a porous electrode. The stacked flat speaker device 810F is similar to the structure of FIG. 8B, and a difference there between lies in a driving signal connection method. In the present embodiment, one end of the signal source 840 is connected to a porous metal thin films of the first porous electrode 812, the second porous electrode 814 and the third porous electrode 824, and another end of the signal source 840 is connected to the first electrode layer 816 in the first vibrating membrane and the second electrode layer 826 in the second vibrating membrane.

The sound holes of the first, the second and the third porous electrodes of each of the embodiments of the disclosure are correspondingly disposed and are coaxial. However, the sound holes can also be disposed in interlace and are not coaxial.

Based on different designs of FIGS. 7A-7D or FIGS. 8A-8F, the sound-pressure specification required for product application is provided. The aforementioned flat speaker units are assembled into various combinations without increasing the complexity of the circuit design. For example, according to the aforementioned design concept, the electret charges of the flat speaker units are collocated according to the odd/even polarities thereof. Subsequently, a set of external audio signals is provided in corporation with the audio signal input connection design to enhance the sound volume output (and reduce the audio distortion thereof). It should be noted that the embodiments described with reference of FIGS. 7A-7D or FIGS. 8A-8F are some application examples. Regarding the flat speaker device with high reliability provided by the disclosure, the flat speaker units provided in the aforementioned embodiments can be arbitrarily combined to achieve unlimited combination designs, which are all within the scope of the embodiment.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A flat speaker unit, comprising a first porous electrode, a second porous electrode, a vibrating membrane with an electret layer and an electrode layer disposed therebetween, wherein the first porous electrode comprises a first porous metal thin film and a first porous layer, the second porous electrode comprises a second porous metal thin film and a second porous layer, and an air gap is respectively formed between the first porous electrode and the vibrating membrane and between the second porous electrode and the vibrating membrane, so as to produce sounds through forces between the first porous electrode, the second porous electrode and the vibrating membrane, wherein the electrode layer is formed on the electret layer, a plurality of first supporting members are disposed between and contacted to the first porous electrode and the vibrating membrane, a plurality of second supporting members are disposed between and contacted to the second porous electrode and the vibrating membrane, and the first porous electrode, the second porous electrode and the vibrating membrane are combined, supported and spaced from each other by a frame supporter, wherein the flat speaker unit is fixed by the frame supporter.

2. The flat speaker unit as claimed in claim 1, wherein the first porous metal thin film of the first porous electrode is electrically connected to a first end of a signal source, and the second porous metal thin film of the second porous electrode is electrically connected to a second end of the signal source.

3. The flat speaker unit as claimed in claim 1, wherein the first porous metal thin film of the first porous electrode and the second porous metal thin film of the second porous electrode are electrically connected to a first end of a signal source, and the vibrating membrane is electrically connected to a second end of the signal source.

4. The flat speaker unit as claimed in claim 1, wherein the first porous metal thin film of the first porous electrode, the second porous metal thin film of the second porous electrode and the vibrating membrane are electrically connected to a signal source, and the connection relation is determined according to an electrical property of the electret layer of the vibrating membrane.

5. The flat speaker unit as claimed in claim 1, wherein the flat speaker unit has a bending curvature to change a directional angle.

6. The flat speaker unit as claimed in claim 1, wherein a material of the electret layer is an electret composite material with micro-scale or nano-scale pores.

7. The flat speaker unit as claimed in claim 6, wherein the electret composite material with micro-scale or nano-scale pores is selected from a group consisting of fluorinated hylenepropylene (FEP), polytetrafluoethylene (PTFE), polyvinylidene fluoride (PVDF), compounds having double carbon bonds, and partial fluorine-contained polymers.

8. The flat speaker unit as claimed in claim 1, wherein the first porous electrode, the second porous electrode and the vibrating membrane are flexible and transparent materials.

9. The flat speaker unit as claimed in claim 8, wherein a polymer material of the vibrating membrane is one of polycarbonate (PC), polyethylene terephthalate (PET), cyclic olefin copolymer (COC), and polymethyl methacrylate (PMMA), or a combination thereof.

10. The flat speaker unit as claimed in claim 1, wherein materials of the first porous metal thin film of the first porous electrode and the second porous metal thin film of the second porous electrode comprise iron, copper, aluminium or alloys thereof.

11. The flat speaker unit as claimed in claim 1, wherein materials of the first porous layer the first porous electrode and the second porous layer of the second porous electrode comprise one of metal fiber, oxide metal fiber, carbon fiber and graphite fiber or combinations thereof.

12. The flat speaker unit as claimed in claim 1, wherein materials of the first porous electrode and the second porous electrode comprise a transparent material, and the material is one of indium tin oxide (ITO), indium zinc oxide (IZO) and aluminium zinc oxide (AZO) or combinations thereof.

13. The flat speaker unit as claimed in claim 1, wherein the first porous layer or the second porous layer is composed of plastic, rubber, paper, cotton fiber, or polymer fiber, and the conductive layer is aluminium, gold, silver, copper, or alloys thereof, or a dual-metal material of Ni/Au, or one of ITO and IZO or a combination thereof, or a polymer conductive material PEDOT.

14. The flat speaker unit as claimed in claim 1, the first porous metal thin film layer of the first porous electrode being disposed facing the vibrating membrane, and the first porous layer layer being disposed towards a sound outgoing direction; and the second porous metal thin film of the second porous electrode being disposed facing the vibrating membrane, and the second porous layer being disposed towards a sound outgoing direction.

15. The flat speaker unit as claimed in claim 1, the first porous layer of the first porous electrode being disposed facing the vibrating membrane, and the first porous metal thin film being disposed towards a sound outgoing direction; and the second porous metal thin film of the second porous electrode being disposed facing the vibrating membrane, and the second porous layer being disposed towards a sound outgoing direction.

16. The flat speaker unit as claimed in claim 1, wherein the first porous layer of the first porous electrode being disposed facing the vibrating membrane, and the first porous metal thin film being disposed towards a sound outgoing direction; and the second porous layer of the second porous electrode being disposed facing to the vibrating membrane, and the second porous metal thin film being disposed towards a sound outgoing direction.

17. The flat speaker unit as claimed in claim 1, wherein the first porous metal thin film of the first porous electrode being disposed facing the vibrating membrane, and the first porous layer being disposed towards a sound outgoing direction; and the second porous layer of the second porous electrode being disposed facing the vibrating membrane, and the second porous metal thin film being disposed towards a sound outgoing direction.

18. The flat speaker unit as claimed in claim 1, wherein the first porous electrode and the second porous electrode are riveted through a rivet and a pad, the first porous electrode and the second porous electrode have a same polarity, and an electrical connection terminal is disposed between the first porous electrode and the second porous electrode.

19. The flat speaker unit as claimed in claim 1, wherein the first porous electrode and the second porous electrode are riveted through a rivet and a pad, the first porous electrode and the second porous electrode have different polarities, and an electrical insulating layer is disposed between the first porous electrode and the second porous electrode.

20. The flat speaker unit as claimed in claim 1, wherein an electrode plate is disposed on the electrode layer of the vibrating membrane, the electrode plate comprises a main body and a plurality of finger-type protrusions, and the main body is located on a frame supporter, so that the finger-type protrusion is electrically connected to the vibrating membrane.

21. The flat speaker unit as claimed in claim 20, wherein a bonding method of the plurality of the finger-type protrusions and the vibrating membrane is implemented through high temperature lamination of a conductive adhesive or an anisotropic conductive film (ACF).

22. The flat speaker unit as claimed in claim 1, wherein the first supporting members and the second supporting members respectively comprise a first layout pattern and a second layout pattern, wherein the first layout pattern and the second layout pattern are respectively disposed between the first porous electrode and the vibrating membrane, and the second porous electrode and the vibrating membrane, wherein profiles of the first and second patterns are determined by the electrostatic effect therebetween.

23. The flat speaker unit as claimed in claim 22, wherein the first layout pattern and the second layout pattern are arranged according to shapes of the supporting members or allocation positions of the supporting members.

24. The flat speaker unit as claimed in claim 1, wherein a shape of the first supporting members and/or a shape of the second supporting members are/is one of a dot shape, a grating shape, a cross shape, a triangular cylinder, a cylinder or a rectangle.

25. The flat speaker unit as claimed in claim 1, wherein the first supporting members and the second supporting members are formed according to a printing technique, a direct printing method, a laser processing method or a cutting technique and a stamping technique.

26. The flat speaker unit as claimed in claim 1, wherein the first supporting members and the second supporting members are respectively adhered between the first porous electrode and the vibrating membrane and between the second porous electrode and the vibrating membrane through adhesion.

27. A flat speaker device, comprising a plurality of the flat speaker units as claimed in claim 1.

* * * * *